US010926571B2

(12) United States Patent
Brehm et al.

(10) Patent No.: US 10,926,571 B2
(45) **Date of Patent: *Feb. 23, 2021**

(54) METHOD FOR PRODUCING A MULTILAYER ELEMENT, AND MULTILAYER ELEMENT

(71) Applicant: LEONHARD KURZ Stiftung & Co. KG, Furth (DE)

(72) Inventors: Ludwig Brehm, Adelsdorf (DE); Tibor Mannsfeld, Georgensgmund (DE); Juri Attner, Burgthann (DE); Thorsten Schaller, Nuremberg (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 309 days.

This patent is subject to a terminal disclaimer.

(21) Appl. No.: 16/016,919

(22) Filed: Jun. 25, 2018

(65) Prior Publication Data

US 2018/0304667 A1 Oct. 25, 2018

Related U.S. Application Data

(63) Continuation of application No. 14/900,646, filed as application No. PCT/EP2014/063623 on Jun. 26, 2014, now Pat. No. 10,029,505.

(30) Foreign Application Priority Data

Jun. 28, 2013 (DE) ..... 10 2013 106 827.8

(51) Int. Cl.

| | |
|---|---|
| ***B42D 25/30*** | (2014.01) |
| ***B42D 25/351*** | (2014.01) |
| ***B42D 25/42*** | (2014.01) |
| ***B42D 25/41*** | (2014.01) |
| ***B42D 25/45*** | (2014.01) |

(Continued)

(52) U.S. Cl.

CPC ..... *B42D 25/30* (2014.10); *B05D 7/50* (2013.01); *B42D 25/324* (2014.10);

(Continued)

(58) Field of Classification Search

CPC .... B42D 25/30; B42D 25/324; B42D 25/328; B42D 25/351; B42D 25/373;

(Continued)

(56) References Cited

U.S. PATENT DOCUMENTS

| | | |
|---|---|---|
| 4,564,571 A | 1/1986 | Masaki |
| 5,289,547 A | 2/1994 | Ligas et al. |

(Continued)

FOREIGN PATENT DOCUMENTS

| | | |
|---|---|---|
| CN | 1652945 | 8/2005 |
| DE | 19813314 | 9/1999 |

(Continued)

*Primary Examiner* — John A McPherson

(74) *Attorney, Agent, or Firm* — Hoffmann & Baron, LLP

(57) ABSTRACT

A method for producing a multilayer body, as well as a multilayer body produced thereby. A single- or multi-layered first decorative ply is applied to a carrier ply with a first and a second side. A metal layer is applied to the side of the first decorative ply facing away from the carrier ply and structured such that the metal layer is provided with a first layer thickness in one or more first zones and is provided with a second layer thickness different from the first layer thickness in one or more second zones, wherein in particular the second layer thickness is equal to zero. A single- or multi-layered second decorative ply is applied to the side of the metal layer facing away from the first decorative ply and structured using the metal layer as mask such that the first or second decorative ply is at least partially removed in the first or second zones.

22 Claims, 8 Drawing Sheets

(51) Int. Cl.

| | |
|---|---|
| ***B42D 25/324*** | (2014.01) |
| ***B42D 25/328*** | (2014.01) |
| ***B42D 25/387*** | (2014.01) |
| ***B42D 25/445*** | (2014.01) |
| ***B42D 25/378*** | (2014.01) |
| ***B42D 25/373*** | (2014.01) |
| ***B42D 25/405*** | (2014.01) |
| ***B05D 7/00*** | (2006.01) |

(52) U.S. Cl.
CPC ..... *B42D 25/328* (2014.10); *B42D 25/351* (2014.10); *B42D 25/373* (2014.10); *B42D 25/378* (2014.10); *B42D 25/387* (2014.10); *B42D 25/405* (2014.10); *B42D 25/41* (2014.10); *B42D 25/42* (2014.10); *B42D 25/445* (2014.10); *B42D 25/45* (2014.10)

(58) Field of Classification Search
CPC .. B42D 25/378; B42D 25/387; B42D 25/405; B42D 25/45; B42D 25/40; B42D 2033/20; B42D 2033/06; B42D 2033/10
USPC ..... 283/72, 92, 94; 216/32, 50
See application file for complete search history.

(56) References Cited

U.S. PATENT DOCUMENTS

| | | | | |
|---|---|---|---|---|
| 5,470,644 | A | 11/1995 | Durant | |
| 6,627,286 | B1 | 9/2003 | Lutz | |
| 10,029,505 | B2 * | 7/2018 | Brehm | B42D 25/373 |
| 2005/0180016 | A1 | 8/2005 | Wild et al. | |
| 2006/0249042 | A1 | 11/2006 | Heim et al. | |
| 2007/0085337 | A1 | 4/2007 | Endres et al. | |
| 2008/0050660 | A1 | 2/2008 | Staub et al. | |
| 2008/0310025 | A1 | 12/2008 | Staub et al. | |
| 2010/0045024 | A1 | 2/2010 | Attner et al. | |
| 2011/0003166 | A1 | 1/2011 | Brehm et al. | |
| 2011/0095518 | A1 | 4/2011 | Hoffmuller et al. | |
| 2011/0127762 | A1 | 6/2011 | Hoffmuller et al. | |
| 2012/0156446 | A1 | 6/2012 | Brehm et al. | |

FOREIGN PATENT DOCUMENTS

| | | | |
|---|---|---|---|
| DE | 102008013073 | | 9/2009 |
| EP | 0181770 | | 5/1986 |
| EP | 1747905 | | 1/2007 |
| EP | 1846253 | | 9/2008 |
| EP | 2001668 | | 1/2013 |
| JP | 59182782 | | 10/1984 |
| JP | H03-50000 | A | 3/1991 |
| JP | 2010518432 | | 5/2010 |
| JP | 2012-242411 | A | 12/2012 |
| JP | 2012-533760 | | 12/2012 |
| WO | WO2003095227 | | 11/2003 |
| WO | WO2005053968 | | 6/2005 |
| WO | WO2006084686 | | 8/2006 |
| WO | WO2010000470 | | 1/2010 |
| WO | WO2011006634 | | 1/2011 |

* cited by examiner

METHOD FOR PRODUCING A MULTILAYER ELEMENT, AND MULTILAYER ELEMENT

This application is a continuation application of U.S. application Ser. No. 14/900,646, filed Dec. 22, 2015, which claims priority based on an International Application filed under the Patent Cooperation Treaty, PCT/EP2014/063623, filed on Jun. 26, 2014 and German Application No. DE 102013106827.8, filed on Jun. 28, 2013.

BACKGROUND OF THE INVENTION

The invention relates to a method for producing a multilayer body with a carrier ply and a single- or multi-layered decorative ply formed on and/or in the carrier ply, as well as a multilayer body, a security element and a security document.

Optical security elements are often used to make it difficult to copy documents or products, in order to prevent abuse thereof, in particular forgery. Optical security elements are thus used for the security of documents, banknotes, credit and prepaid cards, ID cards, packaging for high-value products and the like. It is known here to use optically variable elements as optical security elements which cannot be duplicated using conventional copying methods. It is also known to equip security elements with a structured metal layer which is formed in the shape of text, a logo or another pattern.

The production of a structured metal layer made of a metal layer applied to the surface for example by sputtering or vapor deposition requires a plurality of processes, in particular if particularly fine structures, which have a high degree of protection against forgery, are to be produced. Thus it is known, for example, to use positive or negative etching or laser ablation to partially demetallize, and thereby structure, a metal layer applied over the whole surface. Alternatively it is possible to apply metal layers to a carrier already in a structured form by means of using evaporation masks.

The more manufacturing steps are provided for the production of the security element, the greater the significance given to the registration or register accuracy of the individual method steps, i.e. the accuracy of the positioning of the individual tools relative to each other during the formation of the security element with respect to features or layers or structures already present on the security element.

SUMMARY OF THE INVENTION

An object of the present invention is to specify a multilayer body which is particularly difficult to reproduce and a method for producing such a multilayer body.

The object is achieved by a method for producing a multilayer body, in particular an optical security element or an optical decorative element, wherein in the method:

a) a single- or multi-layered first decorative ply is applied to a carrier ply;

b) at least one metal layer is applied to the side of the first decorative ply facing away from the carrier ply;

c) the at least one metal layer is structured such that the metal layer is provided with a first layer thickness in one or more first zones of the multilayer body and is provided with a second layer thickness different from the first layer thickness in one or more second zones of the multilayer body, wherein in particular the second layer thickness is equal to zero;

d) a single- or multi-layered second decorative ply is applied to the side of the metal layer facing away from the first decorative ply;

e) the first and/or second decorative ply is structured in a first area of the multilayer body using the metal layer as mask such that the first and/or second decorative ply is at least partially removed in the first or second zones.

Steps a) to e) of the method according to the invention are preferably to be carried out in the stated order.

The object is furthermore achieved by a multilayer body, with a single- or multi-layered first decorative ply, a single- or multi-layered second decorative ply and at least one metal layer arranged between the first and second decorative plies, wherein the metal layer is structured such that in a first area of the multilayer body the at least one metal layer is provided with a first layer thickness in one or more first zones of the multilayer body and is provided with a second layer thickness different from the first layer thickness in one or more second zones of the multilayer body, wherein in particular the second layer thickness is equal to zero, and wherein the first and second decorative plies are structured congruent with each other as well as with the metal layer. The first and second decorative plies and the metal layer preferably have partial structures, with the result that in the first area the first and second decorative plies are at least partially removed in the first or second zones congruent with each other as well as with the metal layer.

Such a multilayer body can preferably be obtained by means of the above-described methods.

The multilayer body according to the invention can be used, for example, as a label, laminating film, hot-stamping film or transfer film to provide an optical security element which is used for the security of documents, banknotes, credit and prepaid cards, ID cards, packaging for high-value products and the like. The decorative plies and the at least one metal layer arranged registration-accurate relative thereto can act as an optical security element.

The formation of multilayer bodies with a particularly high degree of protection against forgery is achieved by the invention. In the method the metal layer acts as a mask during the production of the multilayer body, preferably as an illumination mask for an illumination, i.e. the photoactivation of a photoactivatable layer which can be comprised of the first and/or second decorative ply, or as a mask to protect the first zones or the second zones, for example, from an attack by solvent, and on the finished multilayer body to provide an optical effect. The metal layer thus fulfills several, completely different functions.

The structuring according to step c) and/or step e) here can also be effected only in a partial area of the multilayer body, which then forms in particular the first area.

The first and second decorative plies are preferably structured, using the metal layer as mask, in the first area such that the first and second decorative plies are in each case at least partially removed in the first or second zones or such that the metal layer is structured using the first or second decorative ply as mask.

The registration-accurate structuring of the first decorative ply, the second decorative ply and the metal layer relative to each other is hereby achieved without the additional use of registration devices, and a very precise positionally accurate structuring of these layers relative to each other is made possible.

In conventional methods for producing an etch mask by means of a mask illumination, wherein the mask is present either as a separate unit, e.g. as a separate film or as a separate glass plate/glass cylinder, or as a subsequently printed layer, the problem can arise that linear and/or non-linear deformations in the multilayer body brought about by earlier process steps, in particular with high levels of thermal and/or mechanical stress, cannot be compensated for completely over the whole surface of the multilayer body by an alignment of the mask on the multilayer body, although the mask alignment is effected using existing registration or register marks (usually arranged on the horizontal and/or vertical edges of the multilayer body). The tolerance fluctuates over the whole surface of the multilayer body within a comparatively large range. With the method, the first and second zones defined by the structuring of the first or second decorative ply or the metal layer are preferably used directly or indirectly as a mask for the structuring of the remaining layers, with the result that these problems are avoided.

The mask formed as decorative ply or as metal layer is thus subjected to all subsequent process steps for the multilayer body, and thereby automatically follows all deformations in the multilayer body itself possibly brought about by these process steps. In this way no additional tolerances, in particular also no additional tolerance fluctuations, can occur over the surface of the multilayer body, as the subsequent production of a mask and the thereby necessary, as registration-accurate as possible, subsequent positioning of this mask which is independent of the previous course of the process are avoided. The tolerances or registration accuracies in the method according to the invention are based only on possibly not absolutely precisely formed edges of the first and second zones as well as of the metal layer, the quality of which is determined by the production method used in each case. The tolerances or registration accuracies in the method according to the invention lie approximately in the micrometer range, and thus far below the resolving power of the eye; i.e. the naked human eye can no longer perceive any tolerances present.

By register or registration accuracy is meant the positionally accurate arrangement of layers lying one over another.

A ply comprises at least one layer. A decorative ply comprises one or more decorative and/or protective layers which are formed in particular as varnish layers. The decorative layers can be arranged on the carrier ply over the whole surface or in a form that is structured patterned.

Where an arrangement of an item in the first zone and/or in the second zone is described in the following, this means that the item is arranged such that the item and the first and/or second zone overlap, viewed perpendicular to the plane of the carrier ply.

The at least one metal layer can consist of a single metal layer or of a sequence of two or more metal layers, preferably different metal layers. Aluminum, copper, gold, silver or an alloy of these metals is preferably used as metal for the metal layers.

It is further advantageous if in step c), i.e. for the structuring of the metal layer, a first resist layer which can be activated by means of electromagnetic radiation is applied to the side of the metal layer facing away from the first decorative ply and the first resist layer is illuminated by means of said electromagnetic radiation using an illumination mask. This is preferably then followed by further steps for structuring the metal layer, such as for example developing, etching and stripping.

It is advantageous if, subsequently, the procedure is as follows: The second decorative ply applied in step d) comprises one or more second colored resist layers which can be activated by means of electromagnetic radiation. In step e) the one or more second, colored resist layers are illuminated by means of said electromagnetic radiation from the side of the carrier ply, wherein the metal layer acts as illumination mask. In this way, the second decorative ply can be structured perfectly registered relative to the metal layer.

In a further advantageous design the one or more second, colored resist layers comprise at least two different colorants or resist layers containing colorants in different concentrations. One or more of the one or more second, colored resist layers can be applied in each case patterned, by means of a printing process. These colored resist layers here are preferably formed patterned to form a first motif.

It is particularly advantageous if the first resist layer is illuminated in step c) from sides of the carrier ply, wherein the mask for the illumination of the first resist layer is formed by the first decorative ply. For this, in the first area the first decorative ply, viewed perpendicular to the plane of the carrier ply, has a first transmittance in the one or more first zones and a second transmittance, greater than the first transmittance, in the one or more second zones, wherein the said transmittances preferably relate to an electromagnetic radiation with a wavelength suitable for photoactivation of the first resist layer.

During the illumination of the photoactivatable layer by means of the said electromagnetic radiation from the side of the carrier ply facing away from the photoactivatable layer through the first decorative ply, the first decorative ply thus acts as an illumination mask, as it has a transmittance in the first zone which is reduced compared with the transmittance of the second zone. The illumination further takes place through the metal layer, and thus through the layer to be structured.

It is furthermore expedient if an, in particular colored, etch resist layer is partially applied to a partial area of the metal layer in which no first resist layer is provided. In a later etching process, due to the etch resist layer, the metal layer can be structured in this partial area independently of the illumination of the first resist layer, whereby further graphical effects can be achieved. The etch resist layer preferably consists of polyvinyl chloride.

The first decorative ply here also fulfills several, completely different functions, namely the function of an illumination mask as well as the provision of an item of optical information.

The first decorative ply is preferably formed such that an observer of an item decorated by means of the multilayer body can observe the at least one metal layer through the first decorative ply. For this, the first decorative ply can be, for example, transparent or translucent. Further, it is also possible for the first decorative ply to form a (colored) second motif visible to the human observer, which is designed independently of the first and second zones. For this, the first decorative ply can be, for example, transparently or translucently dyed.

Through the use of the first decorative ply as illumination mask the first resist layer is structured registration-accurate relative to the first and second zones of the multilayer body, i.e. the structures of the structured first resist layer are arranged registered relative to the first and second zones of the decorative ply. In addition, according to this embodiment of the method, the at least one metal layer is structured registration-accurate relative to the resist layer. The method thus allows the formation of at least four layers formed registration-accurate relative to each other: the first decorative ply, the first resist layer, the at least one metal layer and the second decorative ply. As a result of the method the multilayer body has the metal layer as well as the two decorative plies registration-accurate in the first zone or in the second zone of the multilayer body.

The use of the first decorative ply as illumination mask for the first resist layer or of the metal layer as illumination mask for a second resist layer optionally comprised of the second decorative ply inevitably results in a complete registration accuracy of the respective illumination mask relative to the metal layer or the second decorative ply, i.e. the first decorative ply and the structured metal layer itself function, at least in areas, as illumination masks. The first decorative ply or the metal layer and the illumination mask thus in each case form a common functional unit. The method, which is both simple and effective, results in a substantial advantage over conventional methods in which a separate illumination mask must be registered relative to layers of the multilayer body, wherein in practice registration deviations can be avoided entirely in very few cases.

It is possible for the first decorative ply to comprise a first varnish layer which is arranged on the carrier ply with a first layer thickness in the first zone and either not at all or with a second layer thickness smaller than the first layer thickness in the second zone, with the result that the first decorative ply has the said first transmittance in the first zone and the said second transmittance in the second zone. The mask function of the first decorative ply is hereby implemented in a simple manner.

The varnish layers can be applied patterned in a particularly simple manner using a printing process, for example gravure printing, offset printing, screen printing, inkjet printing, with the result that both the mask function and the desired optical effect are implemented.

In order to be able to implement various optical effects or security features, it is furthermore advantageous if the varnish layers contain a UV absorber and/or a colorant.

In the method variants which comprise illumination through the first decorative ply, it has proved to be advantageous to choose the thickness and the material of the first decorative ply such that the first transmittance is greater than zero. The thickness and the material of the first decorative ply are chosen such that electromagnetic radiation with the wavelength suitable for the photoactivation partially penetrates the first decorative ply in the first zone. The illumination mask formed by the first decorative ply is thus formed radiation-permeable in the first zone.

It has proved to be worthwhile if the thickness and the material of the first decorative ply are chosen such that the ratio between the second and the first transmittance is equal to or greater than 2. The ratio between the first and the second transmittance preferably lies at 1:2, also called 1:2 contrast. A contrast of 1:2 is at least one order of magnitude smaller than in the case of conventional masks. Until now it was not customary to use, for illumination of a resist layer, a mask which has such a low contrast as the preferably used first decorative layer described here. In the case of illumination of a resist with a conventional mask (e.g. a chrome mask) there are opaque (OD>2) and completely transparent areas; the mask thus has a high contrast. A conventional aluminum mask has a typical contrast of 1:100, as the typical transmittance of an aluminum layer lies at values around 1%, corresponding to an optical density (=OD) of 2.0. The transmittance (=T) and the OD are linked to each other as follows: $T=10^{-OD}$ (i.e. OD=0 corresponds to T=100%; OD=2 corresponds to T=1%; OD=3 corresponds to T=0.1%). In contrast to the conventional illumination methods, the resist layer is illuminated not only through a mask with low contrast (=decorative ply), but also through the metal layer.

The area of the photoactivatable first resist layer (of smaller transmittance) illuminated through the first zones is preferably activated to a smaller extent than the area of the photoactivatable first resist layer (of greater transmittance) illuminated through the second zones. During the production of the multilayer body the first resist layer can be applied temporarily to the metal layer, where it is used to structure the metal layer, or else can also be a constituent of the second decorative ply or be used to structure the second decorative ply.

It has proved to be worthwhile if the thickness and the material of the first decorative ply are chosen such that the electromagnetic radiation, measured after one pass through a layer packet consisting of the carrier ply and the decorative ply, has a transmittance of from approx. 0% to 30%, preferably of from approx. 1% to 15%, in the first zone and a transmittance of from approx. 60% to 100%, preferably of from approx. 70% to 90%, in the second zone. The transmittances are preferably chosen from these value ranges such that a contrast of 1:2 results.

According to a second embodiment example the first resist layer is illuminated in step c) from the side facing away from the carrier ply, wherein to illuminate the first resist layer a mask is arranged between the first resist layer and a light source which is used for the illumination. In the first area the mask, viewed perpendicular to the plane of the carrier ply, has a first transmittance in the one or more first zones and a second transmittance, greater than the first transmittance, in the one or more second zones, wherein the said transmittances preferably relate to an electromagnetic radiation with a wavelength suitable for a photoactivation of the first resist layer.

As no structures are yet introduced into the multilayer body at this stage of the method, an external mask can be used without it being able to result in registration problems. The structures produced in the metal layer by means of the external mask themselves then later act, in the described manner, as a mask for the production of further, registration-accurate structures in the first and/or second decorative layer.

It has proved to be worthwhile if, to form the photoactivatable layers, in particular the first and/or second resist layer activated by means of electromagnetic radiation, a positive photoresist is used the solubility of which increases when it is activated by illumination, or a negative photoresist is used the solubility of which decreases when it is activated by illumination. The selective irradiation of a photoactivatable layer through an illumination mask with the aim of locally altering the solubility of the photoactivatable layer by a photochemical reaction is referred to as illumination. Depending on the type of the photochemically achievable change in solubility, a distinction is drawn between the following photoactivatable layers, which can be formed as photoresists: in the case of a first type of photoactivatable layers (e.g. negative resist) their solubility decreases compared with non-illuminated zones of the layer due to illumination, for example because the light leads to hardening of the layer; in the case of a second type of photoactivatable layers (e.g. positive resist) their solubility increases compared with non-illuminated zones of the layer due to illumination, for example because the light leads to decomposition of the layer.

It has further proved to be worthwhile if the first and/or second resist layer is removed in the second zone when a positive photoresist is used or in the first zone when a negative photoresist is used. This can be effected by a solvent such as a base or acid. If a positive photoresist is used the more strongly illuminated second area of the resist layer in the one or more second zones has a higher solubility than the less illuminated first area of the resist layer in the one or more first zones. A solvent therefore dissolves the material of the resist layer (positive photoresist) which is arranged in the second zone more quickly and better than the material of the resist layer which is arranged in the first zone. Through the use of a solvent the resist layer can thus be structured, i.e. the resist layer is removed in the second zone, but is preserved in the first zone.

The first resist layer is then preferably used as an etch mask for an etching step, by which the areas of the metal layer not covered with the first resist layer are, or one of the metal layers is, removed. The first resist layer can then be stripped, i.e. removed.

It is advantageous if, for the illumination of the first and/or second resist layer, UV radiation is used, preferably with a radiation maximum in the region of 365 nm. The transmission properties of the decorative layer used as mask can thus be different in the ultraviolet region and in the visual region. The structure of the mask thus is not dependent on the visually perceptible optical effect which is to be achieved by the decorative layers. In the region of 365 nm, PET (=polyethylene terephthalate), which can form an important constituent of the carrier ply, is additionally transparent. The emission maximum of a high-pressure mercury lamp lies in the region of this wavelength.

It is possible for the first and/or second resist layer to have a thickness in the range of from 0.3 μm to 0.7 μm.

In a further advantageous embodiment of the invention step c) is carried out after step d) and in step c) the metal layer is structured using the second decorative ply as mask, in particular by application of an etchant and removal of the areas of the metal layer not protected by the mask. In step e) the first decorative ply is then structured using the metal layer as mask, in particular by application of a solvent and removal of the areas of the first decorative ply not protected by the mask.

Thus the second decorative ply here has, in addition to the optical function achieved by the dyeing, an additional function as a mask, using which the registration-accurate structuring of the metal layer is subsequently effected. Perfect registration between the second decorative ply and the metal layer can thus be maintained without the use of external masks, with the result that the structures of the two layers cover each other exactly. At the same time, this embodiment makes do without illumination and developing steps, resulting in a particularly simple procedure. After the metal layer has been structured using the second decorative ply, the metal layer can in turn be used as a mask for the structuring of the first decorative ply, for example by removal of the zones of the first decorative ply not covered by the metal layer, using a solvent.

It is furthermore advantageous if the second decorative ply is applied patterned by printing, wherein the second decorative ply is provided with a third layer thickness in the first zones and is provided with a fourth layer thickness different from the third layer thickness in the second zones, wherein in particular the fourth layer thickness is equal to zero. Both the mask function and the desired optical effect of the second decorative ply can hereby be implemented in a simple manner.

In a further advantageous embodiment the second decorative ply is resistant to an etchant used to structure the metal layer as well as to a solvent used to structure the first decorative ply. The second decorative ply can thus act as a protective mask both for the structuring of the metal layer and for the structuring of the first decorative ply.

It is furthermore advantageous if the second decorative ply comprises one or more colored layers which are applied in particular by a printing process.

In a further advantageous design the first resist layer and/or areas of the first decorative ply not protected by the metal layer are removed by a solvent. A preferred embodiment provides for the resist layer likewise to be largely completely removed ("stripped") during the work step for structuring the metal layer or in a separate, subsequent, later work step. Through a reduction in the number of layers lying one over another in the multilayer body, its resistance and durability can be increased, as adhesion problems between adjacent layers are minimized. Furthermore, the optical appearance of the multilayer body can be improved as, after the removal of the resist layer, which can in particular be dyed and/or not completely transparent, but only translucent or opaque, the areas lying underneath it are exposed again. For specific applications without particularly high demands on the resistance or the optical appearance, however, it is also possible to leave the first resist layer on the structured layer.

It has proved to be worthwhile if in step c) the zones of the metal layer not protected by the first resist layer and/or the second decorative ply are removed using an etchant. This can be effected by an etchant such as an acid or base. It is preferred if the removal, in areas, of the resist layer in the respective area and of the thereby exposed areas of the metal layer layer is effected in the same method step. This can be achieved in a simple manner using a solvent/etchant, such as a base or acid, which is capable of removing both the resist layer—in the illuminated area in the case of a positive resist, in the non-illuminated area in the case of a negative resist—and the layer to be structured, i.e. attacks both materials. The resist layer must be formed such that it resists the solvent or etchant used to remove the layer to be structured at least for a sufficient amount of time, i.e. for the exposure time of the solvent or etchant, in the non-illuminated area when a positive resist is used, or in the illuminated area when a negative resist is used.

It has furthermore proved to be worthwhile if the carrier ply on the side facing the first decorative ply comprises at least one functional layer, in particular a detachment layer and/or a protective varnish layer. This is advantageous in particular if the multilayer film is used as a transfer film in which the functional layer makes possible a problem-free detachment of the carrier ply from a transfer ply which comprises at least one layer of the first and second decorative plies and the metal layer.

It is further advantageous if the first and/or second decorative ply comprises a replication varnish layer into which a surface relief is molded and/or if a surface relief is molded into the surface of the carrier ply facing the first decorative ply. The surface relief preferably comprises a diffractive structure, preferably with a spatial frequency of between 200 and 2000 lines/mm, in particular a hologram, a Kinegram®, a linear grating or a crossed grating, comprises a zero-order diffraction structure, in particular with a spatial frequency of more than 2000 lines/mm, a blazed grating, a refractive structure, in particular a microlens array or a retroreflective structure, an optical lens, a freeform surface structure, and/or a mat structure, in particular an isotropic or anisotropic mat structure. Mat structure denotes a structure with light-scattering properties which preferably has a stochastic mat surface profile. Mat structures preferably have a relief depth (peak-to-valley, P-V) of between 100 nm and 5000 nm, further preferably between 200 nm and 2000 nm. Mat structures preferably have a surface roughness (Ra) of between 50 nm and 2000 nm, further preferably between 100 nm and 1000 nm. The mat effect can be either isotropic, i.e. identical at all azimuth angles, or anisotropic, i.e. varying at different azimuth angles.

By a replication layer is generally meant a layer which can be produced with a relief structure on the surface. This includes, for example, organic layers such as plastic or varnish layers or inorganic layers such as inorganic plastics (e.g. silicones), semiconductor layers, metal layers etc., but also combinations thereof. It is preferred that the replication layer is formed as a replication varnish layer. To form the relief structure a radiation-curable or heat-curable (thermosetting) replication layer or a thermoplastic replication varnish layer can be applied, a relief can be molded into the replication layer and the replication layer can optionally be hardened with the relief imprinted therein.

It is further advantageous if, after the structuring of the metal layer, a compensation layer is applied which in particular lies on the areas of surface, facing away from the carrier ply, of the first decorative ply, the second decorative ply and/or the carrier ply.

It is preferred if, after the structuring of the metal layer, the metal layer and the first resist layer are removed in the first or the second zone and are present in the other area, or in the corresponding method variants are present in the zones protected by the second resist layer and removed in the remaining area. Through the application of the compensation layer, recessed areas/recesses of the metal layer, the first decorative ply and/or the second decorative ply can be at least partially filled in. It is possible for recessed areas/recesses of the first or second resist layer also to be at least partially filled in through the application of the compensation layer. The compensation layer can comprise one or more different layer materials. The compensation layer can be formed as a protective and/or adhesive and/or decorative layer.

It is possible for an adhesion-promoter layer (adhesive layer), which can itself also be formed multi-layered, to be applied to the side of the compensation layer turned away from the carrier ply. The multilayer body formed as a laminating film or transfer film can thus be joined to a target substrate adjoining the adhesion-promoter layer, e.g. in a hot-stamping or IMD process (IMD=In-Mold Decoration). The target substrate can be, for example, paper, card, textile or another fibrous material, or a plastic or a composite material made of, for example, paper, card, textile and plastic, and can be flexible or predominantly rigid.

A protective varnish is preferably applied to the multilayer body on the side of the multilayer body facing away from the carrier ply. This protects the multilayer body from environmental influences and mechanical manipulations.

It is further advantageous if the first and/or second decorative ply is bleached by illumination. Photoreactive substances possibly still present in the non-illuminated zones of the multilayer body are thus reacted and a later uncontrolled bleaching is prevented. In this way a particularly color-stable multilayer body is obtained.

The multilayer body preferably comprises a carrier ply in particular over the whole surface. The carrier ply must be permeable to the radiation used in the respective illumination step. In the case of the following carrier materials it is also possible to use electromagnetic radiation with a wavelength in the range of from 254 to 314 nm: olefinic carrier material such as PP (=polypropylene) or PE (=polyethylene), carrier material based on PVC and PVC copolymers, carrier material based on polyvinyl alcohol and polyvinyl acetate, polyester carrier based on aliphatic raw materials.

It is possible for the carrier ply to have a single- or multi-layered carrier film. A thickness of the carrier film of the multilayer body according to the invention in the range of from 12 to 100 μm has proved to be worthwhile. For example PET, but also other plastic materials, such as PMMA (=polymethyl methacrylate), come into consideration as material for the carrier film.

It is particularly expedient if the first decorative ply, viewed perpendicular to the plane of the carrier ply, has a first transmittance in the first zone and a second transmittance, greater than the first transmittance, in the second zone, wherein the said transmittances relate to an electromagnetic radiation in the visual and/or ultraviolet and/or infrared spectrum. As already explained with reference to the method, such a first decorative ply can itself act as illumination mask for the structuring of the metal layer, with the result that a multilayer body with a particularly registration-accurate layer arrangement results.

It is further possible for the second decorative ply to have, in the first zone or the second zone, at least one resist layer which is photoactivated by means of the said electromagnetic radiation, wherein the at least one metal layer and the resist layer are aligned registration-accurate relative to each other.

It is possible for the first and/or second decorative ply to comprise one or more layers which are dyed with at least one opaque and/or at least one transparent colorant which is colored or color-generating at least in a wavelength region of the electromagnetic spectrum, in particular is multicolored or multicolor-generating, in particular for a colorant which can be excited outside the visible spectrum and generates a visually recognizable colored impression to be contained in one or more of the layers of the first and/or second decorative ply. It is preferred if the first and/or second decorative ply is at least partially permeable to visible light with a wavelength in a range of from approximately 380 to 750 nm.

It is possible for the first and/or second decorative ply to be dyed with at least one pigment or at least one colorant with the color cyan, magenta, yellow or black (CMYK=Cyan Magenta Yellow Key; Key: black as color depth) or the color red, green or blue (RGB), in particular in order to produce a subtractive mixed color, and/or to be provided with at least one radiation-excitable pigment or colorant which fluoresces in red and/or green and/or blue and thereby in particular for an additive mixed color to be able to be produced on irradiation. As an alternative to a mixed color, pigments or colorants can also be used which produce a specific, pre-mixed color as a special color or as a color from a specific color system (e.g. RAL, HKS, Pantone®), for example orange or violet.

In the method variants in which an illumination is effected through the first decorative ply, the first decorative ply thereby fulfills a double function. On the one hand the first decorative ply acts as an illumination mask for the formation of at least one metal layer, which is arranged registration-accurate relative to the first and second zones of the multilayer body. In particular, the first decorative ply acts as an illumination mask for a demetallization of a metal layer in areas. On the other hand both decorative plies, or at least one or more layers of the respective decorative ply, on the multilayer body act as an optical element, in particular as a monochromatic or multicolored color layer for a dyeing of the at least one structured layer, wherein the color layer is arranged registration-accurately over and/or next to/adjoining the at least one metal layer.

It is possible for the first and/or second decorative ply to comprise a replication varnish layer, into which a surface relief comprising at least one relief structure is molded and the at least one metal layer is arranged on the surface of the at least one relief structure.

It is possible for the at least one relief structure to be arranged at least partially in the first zone and/or in the second zone. The surface layout of the relief structure can be matched to the surface layout of the first and the second zone, in particular can be formed registered relative thereto, or the surface layout of the relief structure is formed, for example, as a continuous endless pattern independently of the surface layout of the first and second zones. The relief structure can, of course, also be introduced in the method variants which do not require zones with different transmission in the decorative ply and matched to the surface layout of the decorative ply. Through the arrangement according to the invention of the resist layer on the first side of the carrier ply such that the resist layer is arranged on the side of the at least one metal layer turned away from the carrier ply and the decorative ply is arranged on the other side of the at least one metal layer, it is possible to arrange the layer to be structured at least partially on a relief structure, in contrast to structuring methods using washing resist.

It is possible for the first and/or second decorative ply to comprise one or more of the following layers: liquid crystal layer, polymer layer, in particular conductive or semiconductive polymer layer, thin-film interference layer packet, pigment layer.

It is possible for the first and/or decorative ply to have a thickness in the range of from 0.5 μm to 5 μm.

It is possible for UV absorbers to be added to the material for forming the decorative ply, in particular if the material of the decorative ply does not contain a sufficient quantity of UV-absorbing constituents, such as for example UV-absorbing pigments or UV-absorbing colorants. It is possible for the decorative ply to have inorganic absorbers with a high scattering ratio, in particular nanoscale UV absorbers based on inorganic oxides. Above all $TiO_2$ and ZnO in highly dispersed form, such as are also used in sunscreens with a high sun protection factor, have proved to be suitable oxides. These inorganic absorbers lead to a high level of scattering and are therefore suitable in particular for a mat, in particular silk-mat, dyeing of the decorative plies.

However, it is also possible for the decorative plies to have organic UV absorbers, in particular benzotriazole derivatives, with a proportion by mass in a range of from approx. 3% to 5%, in particular if the material of the decorative plies does not contain a sufficient quantity of UV-absorbing constituents, such as for example UV-absorbing pigments or UV-absorbing colorants. Suitable organic UV absorbers are marketed by BASF under the trade name Tinuvin®. It is possible for the decorative ply to have fluorescent colorants or organic or inorganic, fluorescent pigments in combination with highly dispersed pigments, in particular Mikrolith®-K. Through the excitation of these fluorescent pigments, the UV radiation is already largely filtered out in the respective decorative ply, with the result that only an insignificant fraction of the radiation reaches the resist layer. The fluorescent pigments can be used in the multilayer body as an additional security feature.

The use of UV-activatable resist layers offers advantages: through the use of a UV absorber, which has a transparent action in the visual wavelength range, in the first and/or second decorative ply the property "color" of the respective decorative ply in the visual wavelength range can be separated from desired properties of the respective decorative ply to structure the respective resist layer (e.g. sensitive in the near-UV region) and thereby the at least one metal layer. In this way, a high contrast between the first and second zones can be achieved, independently of the visually recognizable dyeing of the decorative plies.

It is possible for the at least one metal layer to have a thickness in the range of from 20 nm to 70 nm. It is preferred that the metal layer of the multilayer body acts as a reflective layer for light incident from sides of the replication layer. Through the combination of a relief structure of the replication layer and a metal layer arranged underneath, it is possible to generate a plurality of different optical effects which can be used effectively for security features. The metal layer can consist, for example, of aluminum or copper or silver, which is galvanically strengthened in a subsequent method step. The metal which is used for the galvanic strengthening can be identical to or different from the metal of the structured layer. An example is e.g. the galvanic strengthening of a thin aluminum layer, copper layer or silver layer with copper.

It is possible for recesses in the first and/or second decorative ply as well as the metal layer to be filled with a compensation layer.

It is preferred if the refractive index n1 of the compensation layer in the visible wavelength range lies in the range of from 90% to 110% of the refractive index n2 of the replication layer. It is preferred if, in the first or second zones in which the metal layer is removed and a spatial structure, i.e. a relief, is formed on the surface, the recesses and elevations of the relief are equalized by means of a compensation layer which has a similar refractive index to the replication layer ($\Delta n = |n2 - n1| < 0.15$). In this way the optical effect formed by the relief in the zones in which the compensation layer is applied directly to the replication layer is no longer perceptible, because no optically sufficiently active boundary surface can form, due to the equalization using a material with a sufficiently similar refractive index.

It is possible for the compensation layer to be formed as an adhesion layer, e.g. adhesive layer.

BRIEF DESCRIPTION OF THE DRAWINGS

The invention is explained by way of example with reference to the drawings. There are shown in.

DETAILED DESCRIPTION OF THE INVENTION

FIGS. 1*a* to 3*e* are in each case drawn schematically and not to scale, in order to ensure a clear representation of the important features.

Figure 1A:
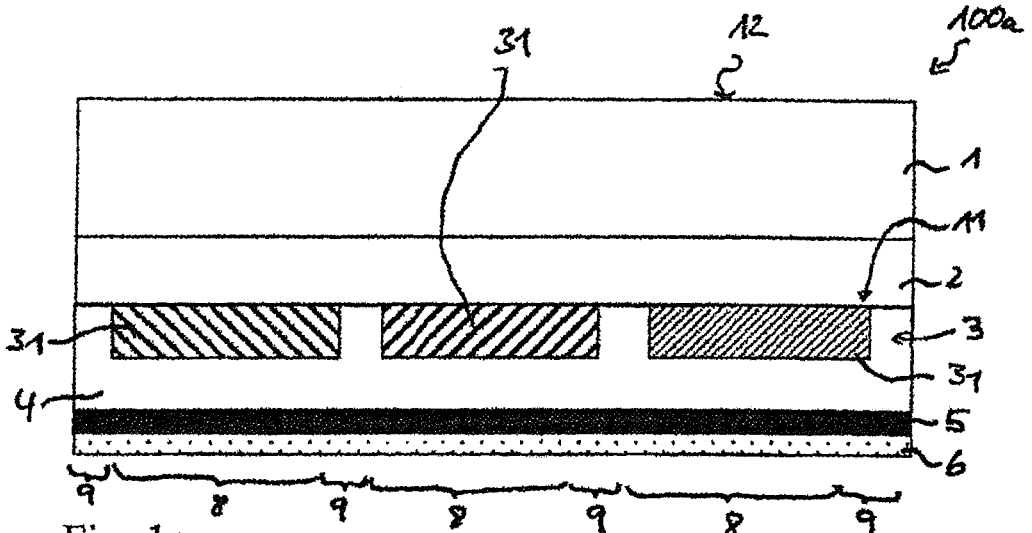
FIG. 1*a* a schematic section of a first manufacturing stage of the multilayer body represented in FIG. 1*d;*
Figure 1B:
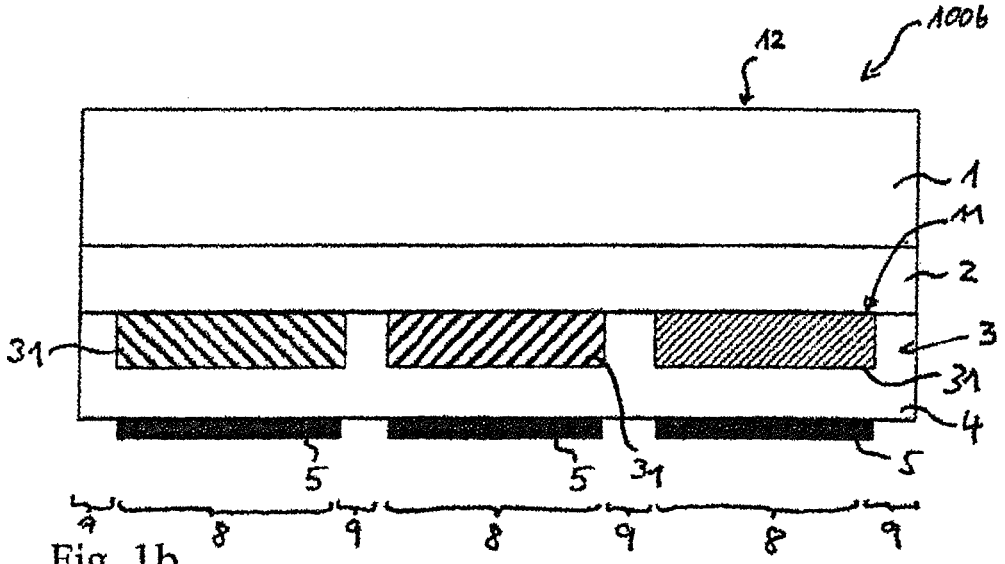
FIG. 1*b* a schematic section of a second manufacturing stage of the multilayer body represented in FIG. 1*d;*
Figure 1C:
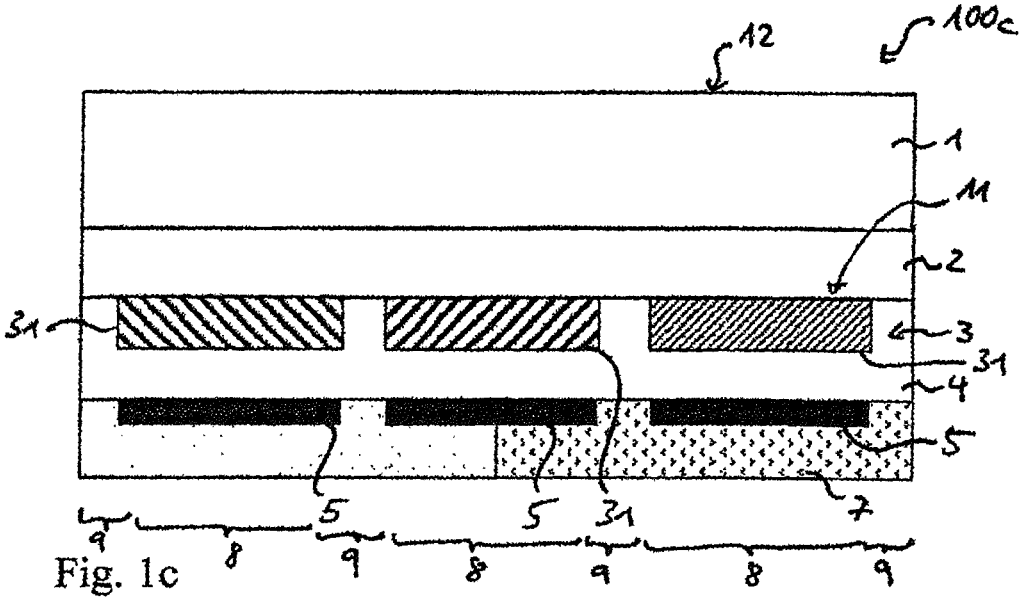
FIG. 1*c* a schematic section of a third manufacturing stage of the multilayer body represented in FIG. 1*d;*
Figure 1D:
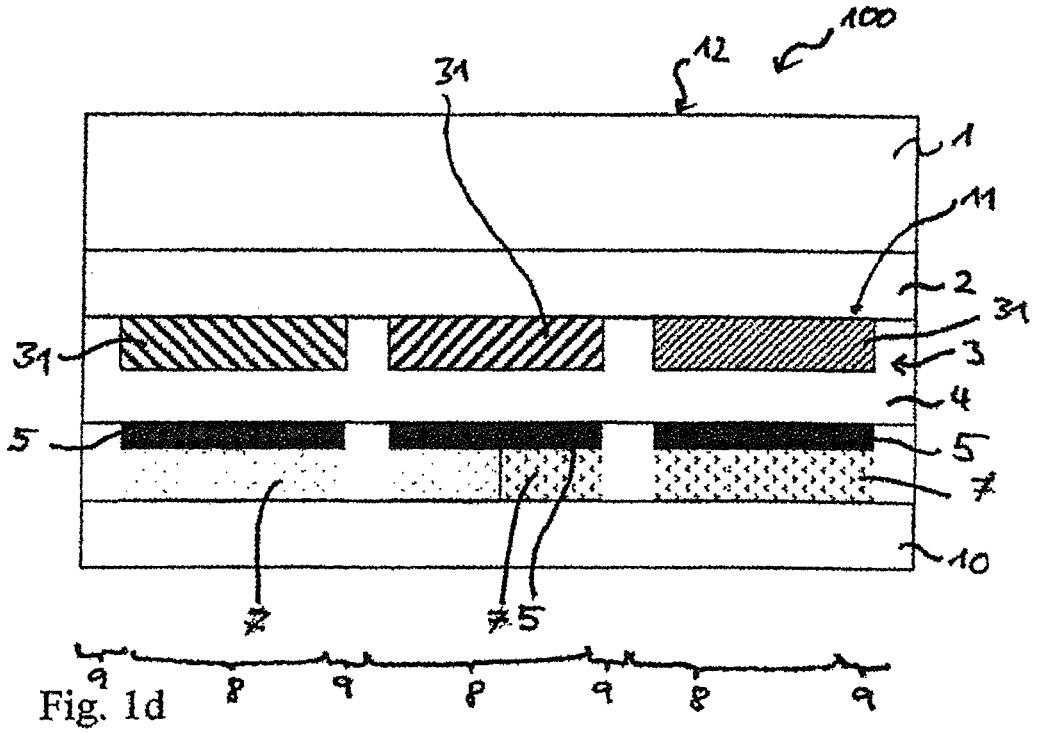
FIG. 1*d* a schematic section of a multilayer body according to the invention produced according to a first embodiment of the method according to the invention.

FIG. 1*a* shows an intermediate product 100*a* in the production of a multilayer body 100, which is represented in the finished state in FIG. 1*d*.

The multilayer body 100 according to FIG. 1*d* comprises a carrier ply with a first side 11 and a second side 12. The carrier ply comprises a carrier film 1 and a functional layer 2. A first decorative ply 3 which comprises a first varnish layer 31 formed in a first zone 8 and a replication layer 4 is arranged on the functional layer 2. A metal layer 5 is arranged on the replication layer 4 registered relative to the first varnish layer 3. A second decorative ply 7 arranged registered relative to the metal layer 5 is provided on the metal layer 5. A compensation layer 10 fills height differences between the replication layer 4, the metal layer 5 and the second decorative ply 7.

The carrier film 1 is a preferably transparent plastic film with a thickness of between 8 μm and 125 μm, preferably in the range of from 12 to 50 μm, further preferably in the range of from 16 to 23 μm. The carrier film 1 can be formed as a mechanically and thermally stable film of a light-permeable material, e.g. of ABS (=acrylonitrile-butadiene-styrene), BOPP (=biaxially oriented polypropylene), but preferably of PET. The carrier film 1 here can be monoaxially or biaxially stretched. Further, it is also possible for the carrier film 1 to consist not only of one layer, but also to consist of several layers. It is thus possible for example for the carrier film 1 to have, in addition to a plastic carrier, for example a plastic film described above, a detachment layer which makes it possible to detach the layer structure consisting of the layers 2 to 6 and 10 from the plastic film, for example when the multilayer body 100 is used as a hot-stamping film.

The functional layer 2 can comprise a detachment layer, e.g. made of hot-melting material, which makes it easier to detach the carrier film 1 from the layers of the multilayer body 100 which are arranged on a side of the detachment layer 2 facing away from the carrier film 1. This is advantageous in particular if the multilayer body 100 is formed as a transfer ply, such as is used e.g. in a hot-stamping process or an IMD process. Furthermore, it has proved to be worthwhile, in particular if the multilayer body 100 is used as a transfer film, if the functional layer 2, in addition to a detachment layer, has a protective layer, e.g. a protective varnish layer. After the multilayer body 100 has been joined to a substrate and the carrier film 1 has been detached from the layers of the multilayer body 100 which are arranged on a side of the detachment layer 2 facing away from the carrier film 1, the protective layer forms one of the upper layers of the layers arranged on the surface of the substrate and can protect layers arranged underneath from wear, damage, chemical attacks or the like. The multilayer body 100 can be a section of a transfer film, for example a hot-stamping film, which can be arranged on a substrate by means of an adhesive layer. The adhesive layer is preferably arranged on the side of the compensation layer 10 facing away from the carrier film 1. The adhesive layer can be a hot-melt adhesive which melts when exposed to heat and joins the multilayer body 100 to the surface of the substrate.

The transparent, colored varnish layer 31 is printed on the functional layer 2 in the zone 8. Transparent means that the varnish layer 31 is at least partially radiation-permeable in the visible wavelength range. Colored means that the varnish layer 31 shows a visible color impression under sufficient natural light.

The varnish layer 31 here can comprise several differently dyed partial areas, as indicated for example by different shading in FIG. 1*d*. A first motif can be provided hereby. Further, the decorative ply 7, as indicated by different shading in FIG. 1*d*, can also form differently colored areas or areas with different optical properties which in particular provide a second motif.

Both the zones 8 on which the varnish layer 31 is printed and the unprinted zones 9 of the functional layer 2 are covered by a replication layer 4 which preferably equalizes possibly present relief structures of the decorative ply 3, i.e. the differing levels in the printed 8 and the unprinted 9 zones.

A thin metal layer 5 is arranged on the replication layer 4 registered relative to and, when viewed perpendicular to the plane of the carrier ply 1, congruent with the varnish layer 31. A second decorative ply 7 is arranged congruent with the metal layer 5. Both the zones 8 of the replication layer 4 covered with the metal layer 5 and decorative ply 7 and the uncovered zones 9 of the replication layer 4 are covered with a compensation layer 10 which equalizes, i.e. covers and fills in, structures brought about by the relief structures and the metal layer 5 arranged in areas 8 (e.g. relief structure, different layer thicknesses, height offset), with the result that the multilayer body has a flat, substantially structureless, surface on the side of the compensation layer 10 turned away from the carrier film 1.

If the compensation layer 10 has a similar refractive index to the replication layer 4, i.e. if the refractive index difference is smaller than approximately 0.15, then the zones of the relief structures in the replication layer 4 not covered with the metal layer 5 and directly adjoining the compensation layer 10 are optically erased, because there are no longer any optically recognizable layer boundaries between the replication layer 4 and the compensation layer 10 there due to the similar refractive index of the two layers.

FIGS. 1*a* to 1*c* now show manufacturing stages of the multilayer body 100 represented in FIG. 1*d*. Elements identical to those in FIG. 1*d* are given identical reference numbers.

FIG. 1*a* shows a first manufacturing stage 100*a* of the multilayer body 100, in which on a first side 11 the carrier film 1 comprises a functional layer 2, on which in turn a decorative ply 3 is arranged. One side of the functional layer 2 adjoins the carrier film 1, its other side adjoins the decorative ply 3. The decorative ply 3 has a first zone 8, in which a varnish layer 31 is formed, and a second zone 9, in which the varnish layer 31 is not present. The varnish layer 31 is printed onto the functional layer 2, e.g. by screen printing, gravure printing or offset printing. A patterned design of the decorative ply 3 results from the formation of the varnish layer 31 in areas (in the first zones 8). Further, it is also possible for the varnish layer to consist of several partial layers which in particular overlap in areas and which have in particular different optical properties, in particular are dyed differently. The varnish layer 31 preferably has a layer thickness of from 0.1 μm to 2 μm, particularly preferably of from 0.3 μm to 1.5 μm.

A replication layer 4, which is a constituent of the first decorative ply 3, is applied to the functional layer 2 and the varnish layer 31 arranged thereon in areas (in the zones 8). This can be an organic layer which is applied in liquid form by standard coating processes, such as printing, casting or spraying. The application of the replication layer 4 here is provided over the whole surface. The layer thickness of the replication layer 4 varies, as it compensates for/equalizes the different levels of the decorative ply 3, comprising the printed first zone 8 and the unprinted second zone 9; the layer thickness of the replication layer 4 is thinner in the first zone 8 than in the second zone 9, with the result that the side of the replication layer 4 turned away from the carrier ply 1 has in a flat, substantially structureless surface before the formation of relief structures.

The replication varnish layer 9 preferably has a layer thickness of from 0.1 μm to 3 μm, particularly preferably of from 0.1 μm to 1.5 μm.

However, an application of the replication layer 4 only in a partial area of the multilayer body 100 can also be provided. The surface of the replication layer 4 can be structured in areas using known methods. For this, for example as replication layer 4, a thermoplastic replication varnish is applied by printing, spraying or varnishing and a relief structure is molded into the, in particular thermally curable/dryable, replication varnish 4 by means of a heated stamp or a heated replication roller. The replication layer 4 can also be a UV-curable replication varnish which is structured for example using a replication roller and at the same time and/or subsequently cured by means of UV radiation. However, the structuring can also be produced by UV radiation through an illumination mask.

The metal layer 5 is applied to the replication layer 4. The metal layer 5 can for example be formed as a vapor-deposited metal layer, e.g. made of silver or aluminum. The application of the metal layer is here provided over the whole surface. However, an application only in a partial area of the multilayer body 100 can also be provided, e.g. with the aid of an evaporation mask that shields in areas.

The metal layer preferably has a layer thickness of from 20 nm to 70 nm.

A photoactivatable resist layer 6 is applied to the metal layer 5. In the present embodiment example the resist layer 6 is formed as a positive resist (dissolving of the activated=illuminated areas). The resist layer 6 can be an organic layer which is applied in liquid form using standard coating processes, such as printing, casting or spraying. It can also be provided that the resist layer 6 is vapor-deposited or laminated on as a dry film.

The photoactivatable layer 6 can be for example a positive photoresist AZ 1512 from Clariant or MICROPOSIT® S1818 from Shipley, which is applied with an area density of from 0.1 g/m$^2$ to 10 g/m$^2$, preferably of from 0.1 g/m$^2$ to 1 g/m$^2$, to the layer 5 to be structured. The layer thickness complies with the desired resolution and the process. The application is provided here over the whole surface. However, an application only in a partial area of the multilayer body 100 can also be provided.

FIG. 1*b* shows a second manufacturing stage 100*b* of the multilayer body 100, in which the first manufacturing stage 100*a* of the multilayer body 100 was irradiated and then developed. Electromagnetic radiation with a wavelength which is suitable for activating the photoactivatable resist layer 6 is radiated through the multilayer body 100*d* from the second side 12 of the carrier film 1, i.e. the side of the carrier film 1 which lies opposite the side of the carrier film 1 coated with the resist layer 6. The irradiation serves to activate the photoactivatable resist layer 6 in the second zone 9, in which the decorative ply 3 shows a higher transmittance than in the first zone 8. The strength and duration of the illumination with the electromagnetic radiation is matched to the multilayer body 100*a* such that the radiation in the second zone 9 leads to an activation of the photoactivatable resist layer 6, while the radiation in the first zone 8 on which the varnish layer 31 is printed does not lead to an activation of the photoactivatable resist layer 6. It has proved to be worthwhile if the contrast between the first zone 8 and the second zone 9 brought about by the varnish layer 31 is greater than two. Further, it has proved to be worthwhile if the varnish layer 31 is designed such that after passing through the whole multilayer body 100*a* the radiation has a ratio of the transmittances, i.e. a contrast ratio, of approximately 1:2 between the first zone 8 and the second zone 9.

The illumination is preferably effected with an illuminance of from 100 mW/cm$^2$ to 500 mW/cm$^2$, preferably of from 150 mW/cm$^2$ to 350 mW/cm$^2$.

To develop the illuminated resist layer 6 a developer solution, e.g. solvents or bases, in particular a sodium carbonate solution or a sodium hydroxide solution, is applied to the surface of the illuminated photoactivatable resist layer 6 turned away from the carrier film 1. The illuminated resist layer 6 has thereby been removed in the second zone 9. The resist layer 6 is preserved in the first zone 8, because the amount of radiation absorbed in these zones has not led to a sufficient activation. As already mentioned, in the embodiment example represented in FIG. 1*a* the resist layer 6 is thus formed from a positive photoresist. In the case of such a photoresist the more strongly illuminated zones 9 are soluble in the developer solution, e.g. the solvent. In contrast, in the case of a negative photoresist the non-illuminated or less strongly illuminated zones 8 are soluble in the developer solution.

The metal layer 5 is then removed in the second zone 9 using an etchant. This is possible because in the second zone 9 the metal layer 5 is not protected by the developed resist layer 6 acting as etch mask from attack by the etchant. The etchant can be for example an acid or base, for example NaOH (sodium hydroxide) or $Na_2CO_3$ (sodium carbonate) in a concentration of from 0.05% to 5%, preferably of from 0.3% to 3%. In this way the areas of the metal layer 5 shown in FIG. 1*b* are formed.

In the next step the preserved areas of the resist layer 6 are likewise also removed ("stripping").

In this way the metal layer 5 can thus be structured registration-accurate relative to the first and second zones 8 and 9 defined by the varnish layer 31 without additional technological outlay. In conventional methods for producing an etch mask by means of mask illumination, wherein the mask is present either as a separate unit, e.g. as a separate film or as a separate glass plate/glass cylinder, or as a subsequently printed layer, the problem arises that linear and/or non-linear deformations in the multilayer body 100 brought about by earlier process steps, in particular with high levels of thermal and/or mechanical stress, e.g. when a replication structure is produced in the replication layer 4, cannot be compensated for completely over the whole surface of the multilayer body 100, although the mask alignment is effected using existing registration or register marks (usually arranged on the horizontal and/or vertical edges of the multilayer body). The tolerance fluctuates over the whole surface of the multilayer body 100 within a comparatively large range.

The first and second zones 8 and 9 defined by the varnish layer 31 are thus used as a mask, wherein the varnish layer 31 is applied, as described above, in an early process step during the production of the multilayer body 100. In this way no additional tolerances and also no additional tolerance fluctuations can occur over the surface of the multilayer body 100, as the subsequent production of a mask and the thereby necessary, as registration-accurate as possible, subsequent positioning of this mask which is independent of the previous course of the process are avoided. The tolerances or registration accuracies in the method according to the invention are based only on the not absolutely precise course of the color edge of the first and second zones 8 and 9 defined by the varnish layer 31, the quality of which is determined by the respectively used printing method, and lie approximately in the micrometer range, and thus far below the resolving power of the eye; i.e. the naked human eye can no longer perceive any tolerances present.

The next intermediate product 100*c* represented in FIG. 1*c* is obtained from the intermediate product 100*b* by, in particular partial, application of a further, second decorative ply 7 to the zones 8 covered by the structured layer 5 and to the zones 9 of the replication layer 4 not covered by the structured layer 5. The second decorative ply 7 comprises at least one second photoactivatable resist layer. The second decorative ply 7 preferably has two or more, in particular differently dyed, second resist layers. The second resist layers here can also be printed patterned. The second resist layers can also be constructed multi-layered. The second resist layers can also be partially colorlessly transparent or translucent, i.e. have no dyeing.

As with the first resist layer 6, the second resist layer can be for example a positive photoresist AZ 1512 from Clariant or MICROPOSIT® S1818 from Shipley, which is applied with an area density of from 0.1 $g/m^2$ to 10 $g/m^2$, preferably of from 0.5 $g/m^2$ to 1 $g/m^2$. The application is provided here over the whole surface. However, an application only in a partial area of the multilayer body 100 can also be provided. As the second decorative ply 7 is to be preserved at least in areas in the finished multilayer body 100, colorants, pigments, nanoparticles or the like can additionally be introduced into the varnish, in order to achieve an optical effect.

The second decorative ply 7 is now also illuminated from the side 12 of the carrier ply 1, for which the parameters already described for the illumination of the first resist layer 6 can be used. During the illumination of the second decorative ply 7 the varnish layer 31 and the metal layer 5 now act together as a mask, with the result that the at least one resist layer of the second decorative ply 7 is only illuminated in the zone 9, while the zone 8 covered by varnish layer 31 and structured layer 5 remains non-illuminated. Like the first resist layer 6, the second decorative ply 7 is now treated, for the developing, with a developer solution, e.g. a base, in particular a sodium carbonate solution or a sodium hydroxide solution. The illuminated resist layer of the second decorative ply 7 is thereby removed in the second zone 9. The second resist layer is preserved in the first zone 8, because the amount of radiation absorbed in these zones has not led to a sufficient activation. When a negative resist is used, this is inverted, as already described, with the result that the second resist layer is removed in the first zone 8 and preserved in the second zone 9.

The multilayer body 100 represented in FIG. 1*d* is formed from the manufacturing stage 100*c* of the multilayer body 100 represented in FIG. 1*c*, by application of a compensation layer 10 to the exposed second decorative ply 7 arranged in the first zone 8 as well as to the replication layer 4 arranged in the second zone 9 and exposed by removal of the metal layer 5 and the first 6 and second resist layer. The application of the compensation layer 10 here is provided over the whole surface.

In particular a UV-crosslinked or a heat-crosslinked varnish is used as compensation layer.

It is possible for the compensation layer 10 to be applied with a different layer thickness in the first zone 8 and the second zone 9 in each case, e.g. by doctor blade, printing or spraying, with the result that the compensation layer 10 has a flat, substantially structureless surface on its side turned away from the carrier ply 1. The layer thickness of the compensation layer 10 varies, as it compensates for/equalizes the different levels of the metal layer 5 arranged in the first zone 8 and the replication layer 4 exposed in the second zone 9. The layer thickness of the compensation layer 10 in the second zone 9 is chosen to be greater than the layer thickness of the metal layer 5 in the first zone 8, with the result that the side of the compensation layer 10 turned away from the carrier ply 1 has a flat surface. However, an application of the compensation layer 10 only in a partial area of the multilayer body 100 can also be provided. It is possible for one or more further layers, e.g. an adhesion or adhesive layer, to be applied to the flat compensation layer 10.

With the described method, the first and second zones 8 and 9 defined by the varnish layer 31 as well as by the metal layer 5 are thus used as a mask for the structuring of the second decorative ply 7. In this way no additional tolerances and also no additional tolerance fluctuations can occur over the surface of the multilayer body 100, as the subsequent production of a mask and the thereby necessary, as registration-accurate as possible, subsequent positioning of this mask which is independent of the previous course of the process are avoided. A multilayer body 100 is thus obtained in which the varnish layer 31 of the decorative ply 3, the metal layer 5 and the second decorative ply 7 are arranged perfectly registered.

Figure 2A:
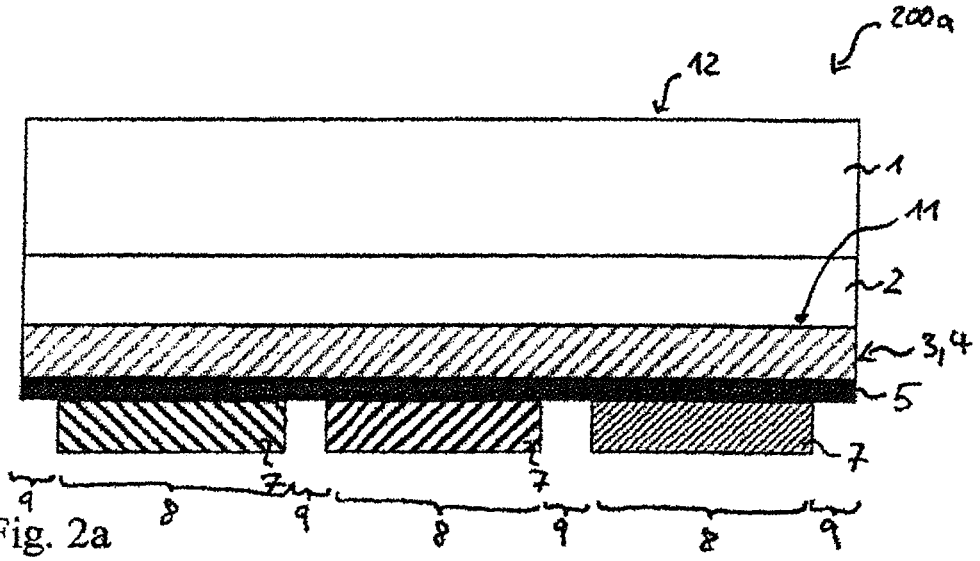
FIG. 2*a* a schematic section of a first manufacturing stage of the multilayer body represented in FIG. 2*d;*
Figure 2B:
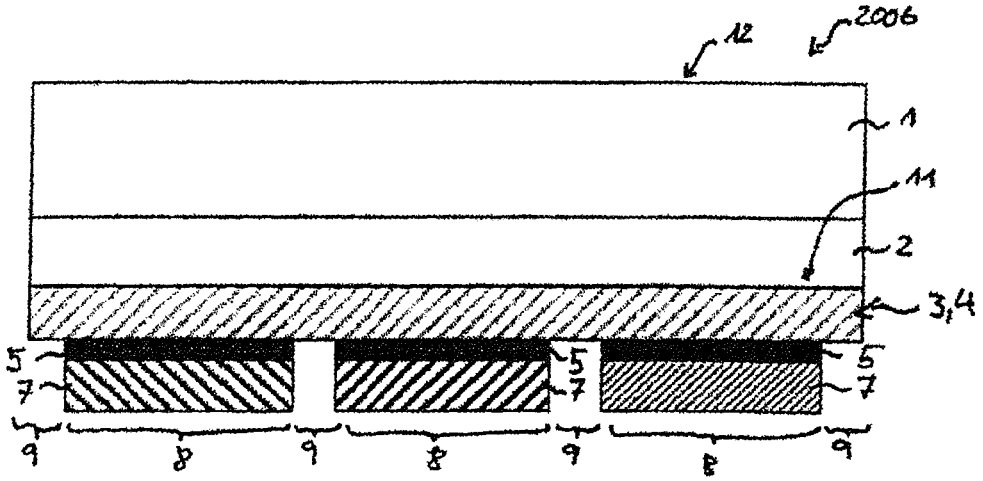
FIG. 2*b* a schematic section of a second manufacturing stage of the multilayer body represented in FIG. 2*d;*
Figure 2C:
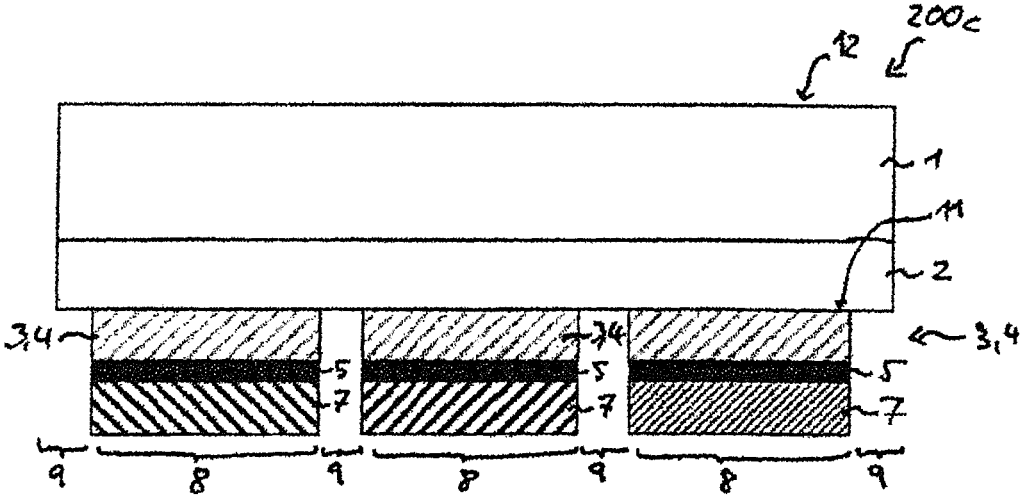
FIG. 2*c* a schematic section of a third manufacturing stage of the multilayer body represented in FIG. 2*d;*
Figure 2D:
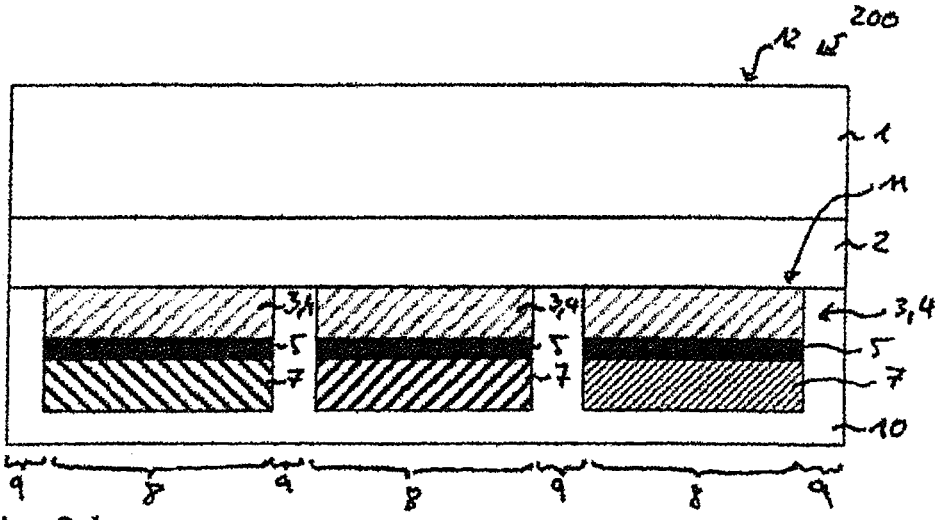
FIG. 2*d* a schematic section of a multilayer body according to the invention produced according to a second embodiment of the method according to the invention.

FIG. 2*d* shows a further multilayer body 200 which is produced using a variant of the method. The method steps and intermediate products 200*a*, 200*b* and 200*c* are shown in FIGS. 2*a* to 2*c*. The further multilayer body 200 corresponds to the multilayer body 100 represented in FIG. 1*d*. The same reference numbers are therefore used for identical structures and functional elements.

The multilayer body 200 also comprises a carrier ply with a first side 11 and a second side 12. The carrier ply comprises a carrier film 1 and a functional layer 2. A first decorative ply 3 which is formed of a replication layer 4 is arranged on the functional layer 2. Alternatively, the decorative ply 3 can also be formed multi-layered and for example can have a dyed layer and a replication layer. A metal layer 5 is arranged on the replication layer 4. A second decorative ply 7 arranged registered relative to the metal layer 5 is provided on the metal layer 5. A compensation layer 10 fills height differences between the replication layer 4, the metal layer 5 and the second decorative ply 7. The materials and application methods already described with reference to the multilayer body 100 can be used for the individual layers.

The multilayer body 200 differs from the multilayer body 100 only in that the decorative ply 3 does not have separate varnish areas 31, but is formed completely from a colored replication varnish, which can contain colorants, pigments, UV-activatable substances, nanoparticles or the like, or alternatively is formed completely from a correspondingly dyed varnish layer and a transparent colorless replication varnish.

During the production of the multilayer body 200 the intermediate product 200*a* shown in FIG. 2*a* is provided first. Analogously to the production of the multilayer body 100 a carrier film 1 is first provided with a functional layer 2, to which the decorative ply 3 is applied over the whole surface. As already described, reliefs, for example diffractive structures, can additionally also be introduced into the replication layer 4 of the decorative ply 3. The replication layer 4 is then metallized over the whole surface in the already described manner. A second decorative ply 7 comprising one or more, also differently dyed, resist layers is now printed onto part of the surface of the thus-obtained metallic layer 5 to be structured, with the result that the metal layer 5 is protected by the second decorative ply 7 in the zone 8, while the metal layer 5 is not covered by the second decorative ply 7 in the zone 9. To produce the desired optical effects, the second decorative ply 7 comprises layers, in particular resist layers, which can contain colorants, pigments, UV-activatable substances, nanoparticles or the like. The second decorative ply 7 can be formed for example from a PVC-based varnish.

In order to obtain the intermediate product 200*b* shown in FIG. 2*b*, the intermediate product 200*a* of the multilayer body 200 is now treated with an etchant, in particular a sodium carbonate solution or a sodium hydroxide solution, which is applied to the surface of the intermediate product 200*a* turned away from the carrier film 1. While the zone 8 is protected by the second decorative ply 7 from the exposure, the base can dissolve the metal layer 5 in the zone 9, with the result that the metal layer 5 is removed in the zone 9. It can hereby be achieved that the metal layer 5 is formed perfectly registered relative to the second decorative ply 7. The second decorative ply 7 here thus acts as an etch resist.

The intermediate product 200*b* is subsequently treated with a solvent, which should preferably have a flash point of more than 65° C. The solvent is chosen such that the second decorative ply 7 is impervious to the solvent, while the material of the replication layer 4 can dissolve in the solvent.

Suitable varnishes in particular for the replication varnish 4, which have these properties, are for example polyacrylates or polyacrylates in combination with cellulose derivatives.

In the zone 8, however, the replication layer is protected by the metal layer 5 and the second decorative ply 7 from attack by the solvent, with the result that the replication layer 4 only dissolves in the unprotected zone 9. The intermediate product 200*c* shown in FIG. 2*c* is obtained hereby.

In order to obtain the finished multilayer body 200, a compensation layer 10 is finally also applied which compensates for possibly present relief structures in the replication layer 4, as well as the removed zones 9 of the replication layer 4 and the metal layer 5, with the result that a smooth surface of the multilayer body 200 results. As with the multilayer body 100, of course, still further functional layers or the like can also be applied.

In contrast to the previously described method, no illumination is thus necessary here in order to obtain an arrangement of three layers (first decorative ply 3, metal layer 5 and second decorative ply 7) in which registration is maintained. The resolution of the produced structures is only limited by the resolution achievable when the second decorative ply 7 is printed as well as by the lateral in-diffusion of the base or of the solvent in the corresponding method steps.

Figure 3A:
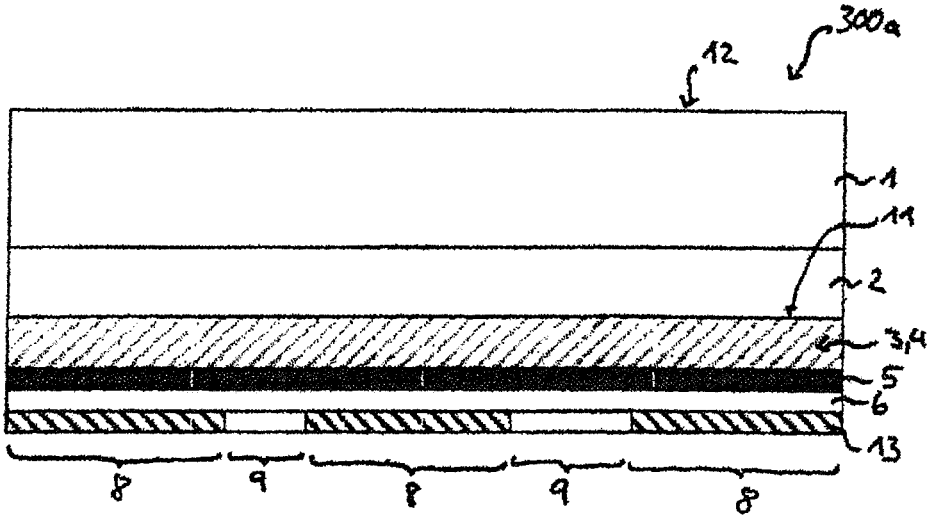
FIG. 3*a* a schematic section of a first manufacturing stage of the multilayer body represented in FIG. 3*e;*
Figure 3B:
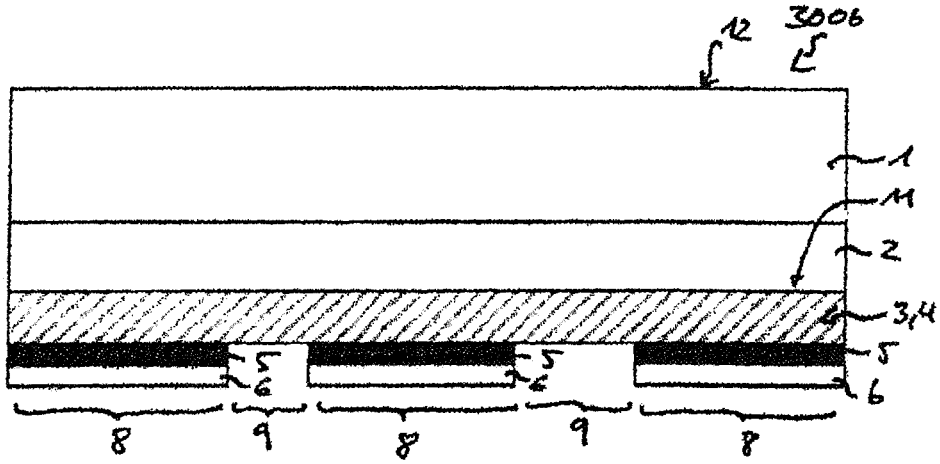
FIG. 3*b* a schematic section of a second manufacturing stage of the multilayer body represented in FIG. 3*e;*
Figure 3C:
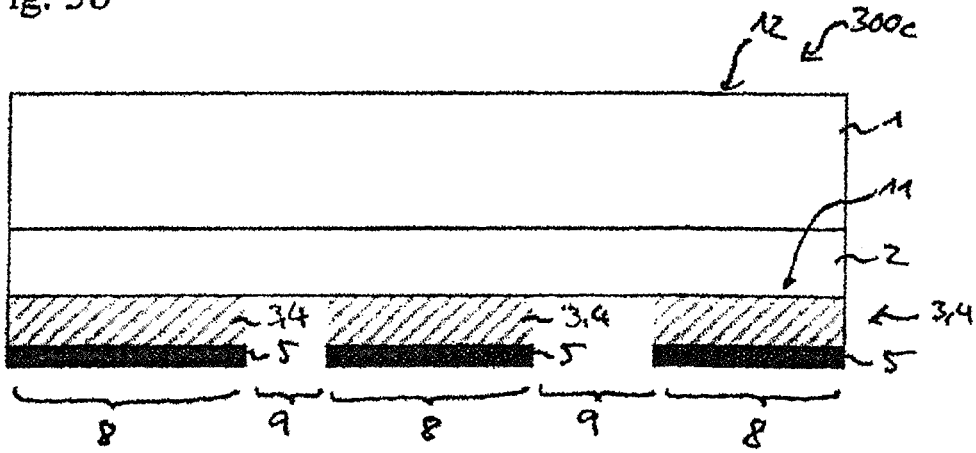
FIG. 3*c* a schematic section of a third manufacturing stage of the multilayer body represented in FIG. 3*e;*
Figure 3D:
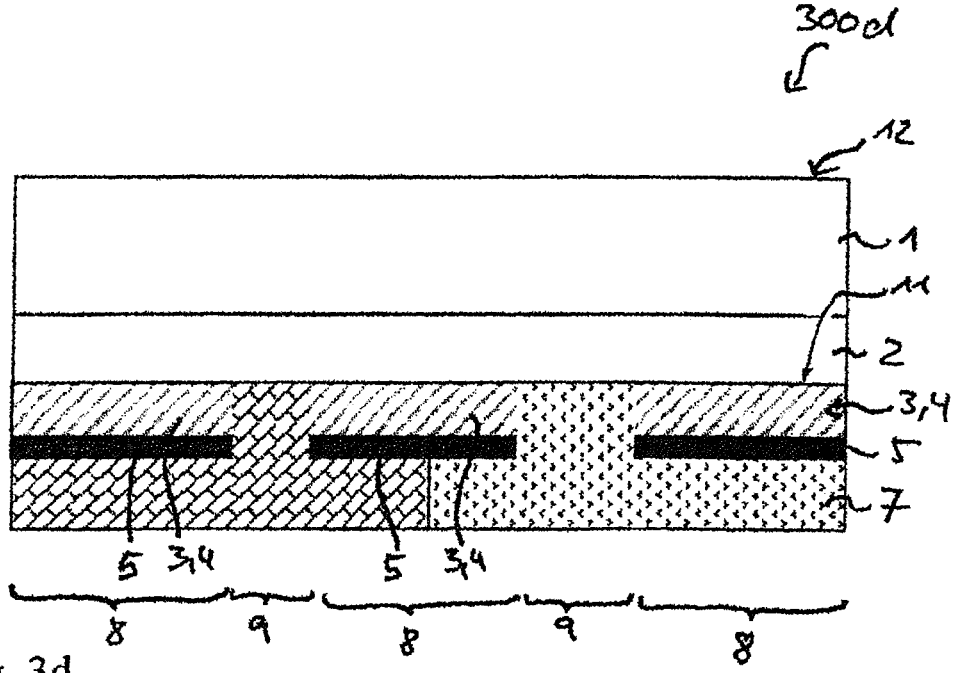
FIG. 3*d* a schematic section of a fourth manufacturing stage of the multilayer body represented in FIG. 3*e;*
Figure 3E:
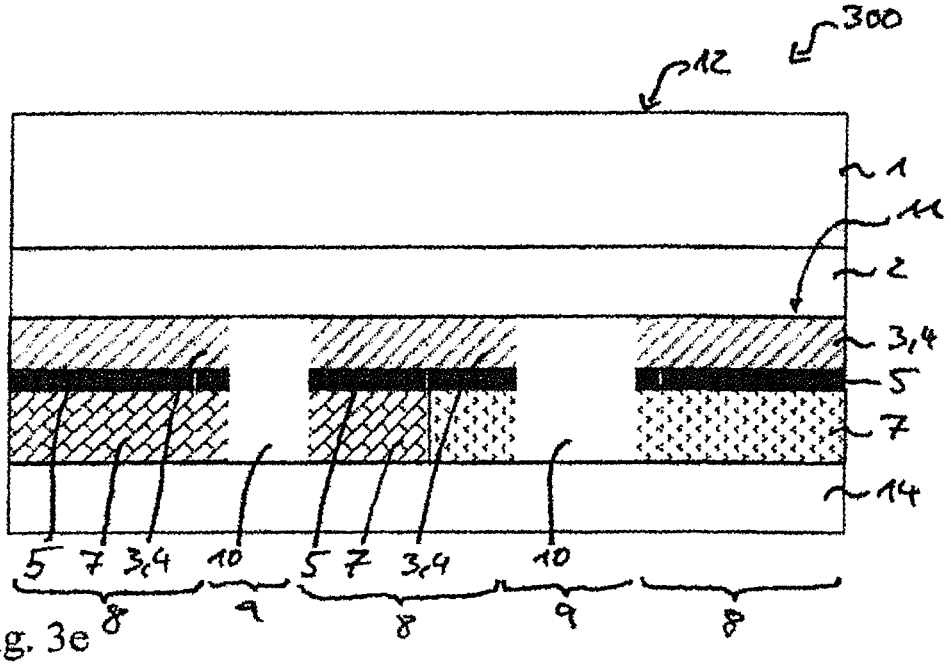
FIG. 3*e* a schematic section of a multilayer body according to the invention produced according to a third embodiment of the method according to the invention.

FIG. 3*e* shows a further multilayer body 300, which is produced using a variant of the method. The method steps and intermediate products 300*a*, 300*b*, 300*c* and 300*d* are shown in FIGS. 3*a* to 3*d*. The further multilayer body 300 likewise corresponds to the multilayer bodies 100 and 200 represented in FIG. 1*d* and FIG. 2*d*. The same reference numbers are therefore used for identical structures and functional elements.

The multilayer body 300 also comprises a carrier ply with a first side 11 and a second side 12, which comprises a carrier film 1 and a functional layer 2. A replication layer 4 which is dyed and at the same time functions as first decorative ply 3 is arranged on this. Alternatively, the decorative ply 3 can also be formed multi-layered and for example can have a dyed layer and a replication layer. A metal layer 5 registered relative to the first decorative ply 3 and a second decorative ply 7 arranged registered relative to the metal layer 5 are provided on the replication layer 4. Height differences of the replication layer 4, the metal layer 5 and the second decorative ply 7 are filled by a compensation layer 10.

The materials and application methods already described with reference to the multilayer body 100 can be used for the individual layers. As with the multilayer body 200, the multilayer body 300 also differs from the multilayer body 100 only in that the decorative ply 3 does not have separate varnish areas 31, but is formed completely from a colored replication varnish, which can contain colorants, pigments, UV-activatable substances, nanoparticles or the like, or alternatively is formed completely from a correspondingly dyed varnish layer and a transparent colorless replication varnish.

FIG. 3*a* shows a first intermediate product 300*a* in the production of the multilayer body 300 according to a variant of the method. Analogously to the production of the multilayer bodies 100 and 200, a carrier film 1 is first provided with a functional layer 2, to which the decorative ply 3 is applied over the whole surface. As already described, reliefs, for example diffractive structures, can additionally also be introduced into the replication layer 4 of the decorative ply 3. The replication layer 4 is then metallized over the whole surface in the already described manner. A resist 6 is now applied to the thus-obtained metal layer 5 over the whole surface.

A mask 13 is now placed on the side of the resist 6 facing away from the carrier film 1. In contrast to the method described for the production of the multilayer body 100, however, the mask 13 here is a separate part, thus is not formed by structures of the multilayer body 300 itself. The mask comprises zones 8, which are non-transparent for the electromagnetic radiation used to illuminate the photoactivatable resist 6, as well as zones 9, which are transparent for said radiation. As the mask 13 is arranged on the side of the resist 6 facing away from the carrier film 1, the illumination of the resist 6 must likewise be effected from this side, thus cannot be effected from the side of the carrier film 1, as in the production of the multilayer body 100. However, all further parameters of the illumination and subsequent developing of the resist 6 correspond to the method explained with reference to the production of the multilayer body 100. After the illumination of the resist 6 the mask 13 can be removed, and the resist 6 can be developed in the already described manner. The metal layer 5 is then structured in the likewise already described manner using an etchant.

A combination of a positive resist 6 with a positive mask 13 is used in the example shown. The resist 6 is thus protected by the mask in the zone 8 and only illuminated in the zone 9. The resist 6 is thus removed in the zone 9 during the developing, with the result that the metal layer 5 is exposed in the zone 5 and is removed by the etchant in the subsequent etching step. Of course, a negative mask in combination with a negative resist can also be used.

After the etching, the intermediate product 300*b* shown in FIG. 3*b* is obtained, in which the structured layer is only still present in the zones 8, while the replication layer 4 is exposed in the zones 9. In addition, the resist 6 is still present in the zones 8 on the surface of the metal layer 5 facing away from the carrier film 1.

In order to obtain the intermediate product 300*c* shown in FIG. 3*c* from the intermediate product 300*b*, the resist 6 is removed ("stripped") by solvent treatment. For this, reference is made to the statements according to FIGS. 2*c* and 2*d*. This can also be effected in the manner already described for the production of the multilayer body 100. When the resist 6 is removed, the replication layer 4 is removed at the same time in the zone 9, in which it is not protected by the metal layer 5.

In the next method step, a second decorative ply 7 is now applied to the metal layer 5 or the exposed zones 9 of the functional layer 2 over the whole surface, with the result that the intermediate product 300*d* shown in FIG. 3*d* is obtained. The second decorative ply 7 comprises at least one layer made of a photoactivatable resist, preferably two or more photoactivatable, differently dyed layers, and at the same time acts as a compensation layer which compensates for the height differences due to the partial removal of the metal layer 5 and the replication layer 4. As with the multilayer body 100, the second decorative ply 7 partially remains in the finished multilayer body and undertakes an optical function there. The second decorative ply 7 therefore comprises at least one layer which is dyed with colorants, pigments, UV-active substances, nanoparticles or the like.

In the intermediate product 300*d*, the zone 8 formed by the remaining decorative ply 3 and the metal layer 5 is non-transparent for the electromagnetic radiation used to illuminate the resist of the second decorative ply 7. Analogously to the production of the multilayer body 100, an illumination of the resist of the second decorative ply 7 can thus now be effected from the side of the carrier film and the resist can then be developed in the already described manner. As the remaining decorative ply 3 acts together with the metal layer 5 as a mask, the resist is thus only illuminated in the zone 9. When a positive resist is used, the resist is thus detached in the zone 9 during the developing, with the result that it is only preserved where it lies directly on the metal layer 5.

In order to achieve the finished multilayer body 300, the zone 9 in which the resist of the second decorative ply 7 was removed is provided with a compensation layer 10, in order to compensate for the height differences. Optionally, a crosslinked, transparent seal layer 14 can also be applied to the side of the multilayer body 300 facing away from the carrier film 1, in order to protect its surface from mechanical damage.

With this method too, a structure of three registration-accurate layers, namely the first decorative ply 3, the metal layer 5 and the second decorative ply 7, is thus obtained. As an external mask is only used for the structuring of the metal layer 5, which then acts as mask for the removal of the replication layer in the zone 8 or for the illumination of the resist of the second decorative ply 7 in the zone 8, the problems described at the beginning in the case of the use of masks do not occur here. The remaining zones 8 of the first decorative ply 3 and of the second decorative ply 7 inevitably form grid-accurate relative to the metal layer 5.

Figure 4A:
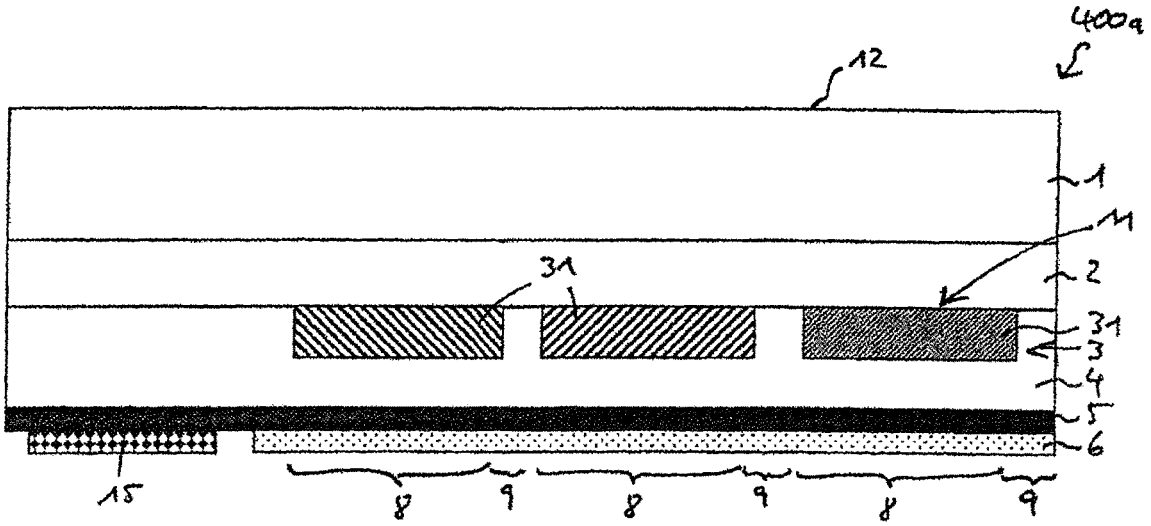
FIG. 4*a* a schematic section of a first manufacturing stage of the multilayer body represented in FIG. 4*d;*
Figure 4B:
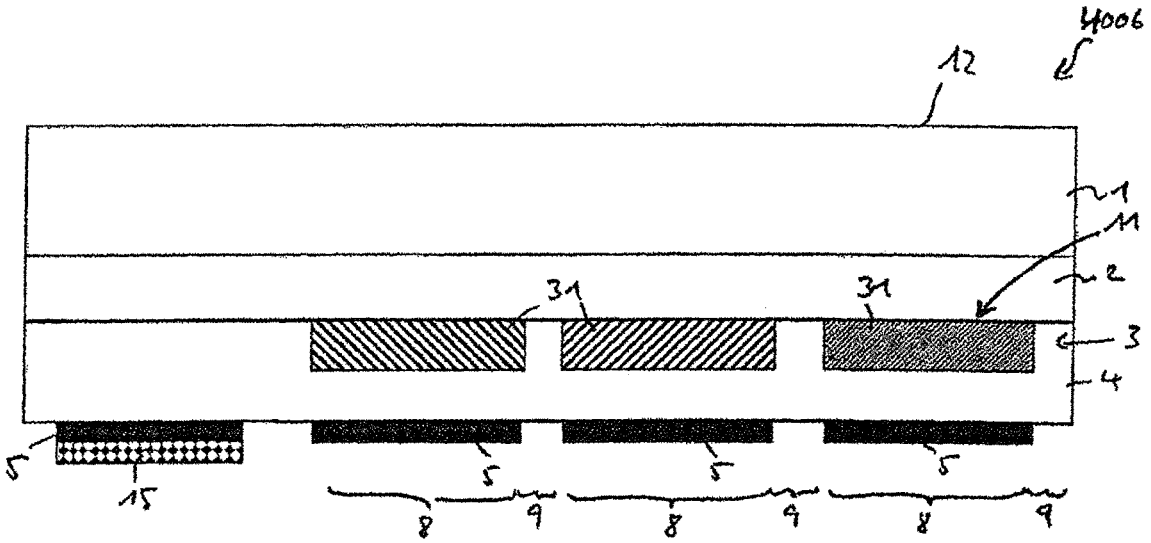
FIG. 4*b* a schematic section of a second manufacturing stage of the multilayer body represented in FIG. 4*d;*
Figure 4C:
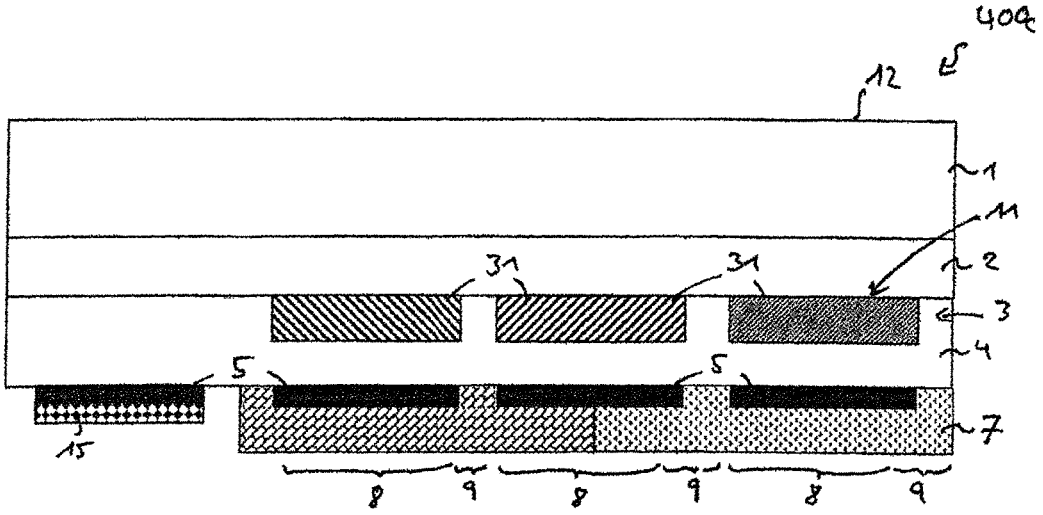
FIG. 4*c* a schematic section of a third manufacturing stage of the multilayer body represented in FIG. 4*d;*
Figure 4D:
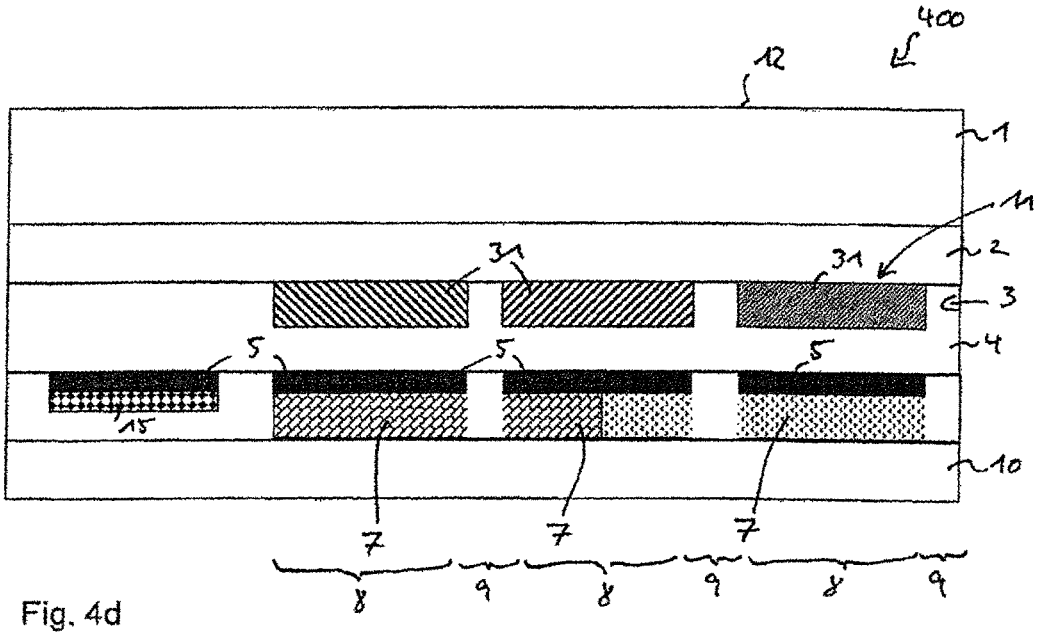
FIG. 4*d* a schematic section of a multilayer body according to the invention produced according to a fourth embodiment of the method according to the invention.

FIG. 4*d* shows a further multilayer body 400, which is produced using a variant of the method. The method steps and intermediate products 400*a*, 400*b* and 400*c* are shown in FIGS. 4*a* to 4*c*.

The multilayer body 400 differs from the multilayer body 100 shown in FIG. 1*a* only in that the second decorative ply 7 is formed of a photoactivatable resist layer in a first partial area and of a partially applied etch resist layer in a second partial area. In the second partial area, as in the first partial area, the decorative ply 3 can have first zones 8 and/or second zones 9.

In the first partial area the structure of the multilayer body 400 corresponds to the multilayer body 100 in FIGS. 1*a* to 1*d* and the method steps described there are also carried out in order to produce a multilayer body 400, as is shown in the first partial area in FIG. 4*d*. Deviating from the multilayer body 100, the second partial area is now provided in which, instead of the photoactivatable resist layer 6, an etch resist layer 15 is partially applied. The motif or the outer shape of the etch resist layer 15 is to determine the motif or the outer shape of the partial metallization to be achieved. The etch resist layer 15 can consist for example of a PVC-based varnish and be dyed by means of pigments and/or colorants or be colorlessly transparent or translucent.

After the developing of the photoactivatable resist layer, the metal layer 5 is removed in the second zone 9 by an etchant. This is possible because in the second zone 9 the metal layer 5 is not protected from attack by the etchant by the developed resist layer 6 acting as etch mask in the first partial area as well as the etch resist layer 15 likewise acting as etch mask in the second partial area. The etchant can be for example an acid or base, for example NaOH (sodium hydroxide) or $Na_2CO_3$ (sodium carbonate) in a concentration of from 0.05% to 5%, preferably of from 0.3% to 3%. In this way, the areas of the metal layer 5 shown in FIG. 4*b* are formed.

In the next step the preserved areas of the resist layer 6 are likewise also removed ("stripping"). However, the etch resist layer 15 is preserved on the metal layer 5.

In this way, the metal layer 5 can thus be structured in the first partial area registration-accurate relative to the first and second zones 8 and 9 defined by the varnish layer 31 and in the second partial area registration-accurate relative to the etch resist layer 15 without additional technological outlay.

As in FIG. 1*c*, in FIG. 4*c* a further, second decorative ply 7 is now applied in the first partial area to the zones 8 covered by the structured layer 5 and to the zones 9 of the replication layer 4 not covered by the structured layer 5. The second decorative ply 7 comprises at least one second photoactivatable resist layer. The second decorative ply 7 preferably has two or more, in particular differently dyed, second resist layers. The second resist layers here can also be printed patterned. The etch resist layer 15 still present in the second partial area likewise forms a part of the decorative ply 7.

Alternatively the application of the decorative ply 7 in the first partial area can also be dispensed with, with the result that the metal layer 5 is present without coating in the first partial area and with the applied etch resist layer 15 in the second partial area. For example, a dyeing of the metal layer 5 by means of dyed etch resist layer 15 can thereby be effected only in the second partial area and although the metal layer 5 is present in the first partial area registration-accurate relative to the first decorative ply, it is not dyed on the side facing away from the first decorative ply and in the case of aluminum reflects in a silvery, glossy manner.

As described with respect to FIGS. 1*c* and 1*d*, the decorative ply 7 is illuminated, developed and partially removed in the first partial area.

As shown in FIG. 1*d*, in the multilayer body 400 represented in FIG. 4*d* is also formed from the manufacturing stage 400*c* of the multilayer body 400 represented in FIG. 4*c* by application of a compensation layer 10 to the exposed second decorative ply 7 arranged in the first zone 8 as well as to the replication layer 4 arranged in the second zone 9 and exposed by removal of the metal layer 5 and the first 6 and second resist layers. The application of the compensation layer 10 here is provided over the whole surface. The compensation layer 10 can be designed single- or multi-layered or can also be dispensed with. It is possible for an adhesion-promoter layer (adhesive layer) (not shown here), which itself can also be formed multi-layered, to be applied to the side of the compensation layer 10 turned away from the carrier ply.

LIST OF REFERENCE NUMBERS

1 Carrier film
2 Functional layer
3 First decorative ply
4 Replication layer
5 Metal layer
6 Resist layer
7 Second decorative ply
8 First zone
9 Second zone
10 Compensation layer
11 First side
12 Second side
13 Mask
14 Seal layer
15 Etch resist layer
31 First varnish layer (of 3)
32 Second varnish layer (of 3)
100 Multilayer body
200 Multilayer body
300 Multilayer body
400 Multilayer body

The invention claimed is:

1. A method for producing a multilayer body, wherein, in the method:

a) a single- or multi-layered first decorative ply is applied to a carrier ply;

b) at least one metal layer is applied to the side of the first decorative ply facing away from the carrier ply;

c) a single- or multi-layered second decorative ply is applied to the side of the metal layer facing away from the first decorative ply;

d) the at least one metal layer is structured using the second decorative ply as a mask by application of an etchant and removal of the areas of the metal layer not protected by the mask such that the metal layer is provided with a first layer thickness in one or more first zones of the multilayer body and is provided with a second layer thickness different from the first layer thickness in one or more second zones of the multilayer body, wherein the second layer thickness is equal to zero;

e) the first decorative ply is structured using the metal layer as a mask in a first area of the multilayer body by application of a solvent and removal of the areas of the first decorative ply not protected by the metal layer mask such that the first decorative ply is at least partially removed in the second zones, wherein the carrier ply comprises, on the side facing the first decorative ply, at least one detachment layer and/or a protective varnish layer, and wherein the first and/or second decorative ply comprises a replication varnish layer into which a surface relief is molded, and/or wherein a surface relief is molded into the surface of the carrier ply facing the first decorative ply.

2. A method according to claim 1, wherein the second decorative ply is applied patterned by printing, wherein the second decorative ply is provided with a third layer thickness in the first zones and is provided with a fourth layer thickness different from the third layer thickness in the second zones, wherein the fourth layer thickness is equal to zero.

3. A method according to claim 1, wherein the second decorative ply is resistant to an etchant used to structure the metal layer as well as to a solvent used to structure the first decorative ply.

4. A method according to claim 1, wherein the second decorative ply comprises one or more colored layers which are applied using a printing process.

5. A method according to claim 1, wherein the surface relief comprises a diffractive structure, a microlens array or a retroreflective structure.

6. A method according to claim 1, wherein, after the structuring of the metal layer, the first decorative ply and/or the second decorative ply, a compensation layer is applied, which lies on the areas of surface, facing away from the carrier ply, of the first decorative ply, the second decorative ply and/or the carrier ply.

7. A method according to claim 1, wherein a protective varnish is applied to the multilayer body on the side of the multilayer body facing away from the carrier ply.

8. A method according to claim 1, wherein the first and/or second decorative ply is bleached by illumination.

9. A multilayer body comprising:

a carrier ply defining a whole surface of the multilayer body, a single- or multi-layered first decorative ply applied to the carrier ply;

a single- or multi-layered second decorative ply; and at least one metal layer arranged between the first and second decorative plies, wherein the metal layer is structured using the second decorative ply as a mask by application of an etchant and removal of the areas of the metal layer not protected by the mask such that, in a first area of the multilayer body, the at least one metal layer is provided with a first layer thickness in one or more first zones of the multilayer body and is provided with a second layer thickness different from the first layer thickness in one or more second zones of the multilayer body, wherein the second layer thickness is equal to zero, and wherein the first decorative ply is structured using the metal layer as a mask by application of a solvent and removal of the areas of the first decorative ply not protected by the metal layer mask such that the first and second decorative plies are structured congruent with each other as well as with the metal layer such that, in the first area in the first or second zones, the first and second decorative plies are at least partially removed congruent with each other as well as with the metal layer, wherein the carrier ply comprises, on the side facing the first decorative ply, at least one detachment layer and/or a protective varnish layer, and wherein the first and/or second decorative ply comprises a replication varnish layer into which a surface relief is molded, and/or wherein a surface relief is molded into the surface of the carrier ply facing the first decorative ply.

10. A multilayer body according to claim 9, wherein the first and/or second decorative ply comprises one or more layers which are dyed with at least one opaque and/or at least one transparent colorant which is colored or color-generating at least in a wavelength range of the electromagnetic spectrum, and is multicolored or multicolor-generating, wherein a colorant is contained in one or more of the layers of the first and/or second decorative ply which can be excited outside the visible spectrum and produces a visually recognizable colored impression.

11. A multilayer body according to claim 9, wherein the first and/or second decorative ply comprises one or more layers which are dyed with at least one colorant of the color yellow, magenta, cyan or black (CMYK) or of the color red, green or blue (RGB), and/or is provided with at least one radiation-excitable pigment or colorant which fluoresces in red and/or green and/or blue and thereby generates an additive color when irradiated.

12. A multilayer body according to claim 9, wherein the at least one metal layer is arranged on the surface of the at least one relief structure.

13. A multilayer body according to claim 12, wherein the at least one relief structure is arranged at least partially in the first zones and/or in the second zones and is arranged congruent with the first or second zones.

14. A multilayer body according to claim 12, wherein recesses of the first and/or of the second decorative ply and/or of the at least one metal layer are filled with a compensation layer, and the refractive index of the compensation layer in the visible wavelength range lies in the range of from 90% to 110% of the refractive index of the replication varnish layer.

15. A multilayer body according to claim 9, wherein first and/or second decorative layer comprises one or more of the following layers: liquid crystal layer, polymer layer, thin-film layer, pigment layer.

16. A multilayer body according to claim 9, wherein the first and/or second decorative ply has a thickness in the range of from 0.5 to 5 μm.

17. A multilayer body according to claim 9, wherein one or more layers of the first and/or second decorative ply has nanoscale UV absorbers based on inorganic oxides.

18. A multilayer body according to claim 9, wherein the metal layer has a thickness in the range of from 20 to 70 nm.

19. A multilayer body according to claim 9, wherein recesses of the first and/or of the second decorative ply and/or of the at least one metal layer are filled with a compensation layer.

20. A multilayer body according to claim 19, wherein the compensation layer is formed as an adhesion layer.

21. A security element for security or value documents, in the form of a transfer film or laminating film, which has a multilayer body according to claim 9.

22. A security document with a security element according to claim 21.

* * * * *